US010362839B2

(12) United States Patent
Minato et al.

(10) Patent No.: US 10,362,839 B2
(45) Date of Patent: Jul. 30, 2019

(54) SLIDE FASTENER

(71) Applicant: YKK Corporation, Tokyo (JP)

(72) Inventors: Tsuyoshi Minato, Macon, GA (US); Suguru Ogura, Macon, GA (US); Mingsi Wang, Macon, GA (US); Yusuke Hosokawa, Kurobe (JP)

(73) Assignee: YKK Corporation (JP)

( * ) Notice: Subject to any disclaimer, the term of this patent is extended or adjusted under 35 U.S.C. 154(b) by 55 days.

(21) Appl. No.: 15/683,089

(22) Filed: Aug. 22, 2017

(65) Prior Publication Data

US 2019/0059524 A1 Feb. 28, 2019

(51) Int. Cl.
*A44B 18/00* (2006.01)
*A44B 19/10* (2006.01)
(Continued)

(52) U.S. Cl.
CPC ..... *A44B 18/0073* (2013.01); *A44B 18/0007* (2013.01); *A44B 19/10* (2013.01); *A44B 19/26* (2013.01); *A44B 19/32* (2013.01)

(58) Field of Classification Search
CPC . A44B 18/0007; A44B 18/0015; A44B 19/26; A44B 19/32; A44B 19/10; Y10T 24/2539
See application file for complete search history.

(56) References Cited

U.S. PATENT DOCUMENTS 2,715,254 A * 8/1955 Tschappu ..... A44B 19/14 24/401
2,993,252 A * 7/1961 De Held ..... A44B 19/26 24/396

(Continued)

FOREIGN PATENT DOCUMENTS

AU 2002318624 9/2005
CN 202026948 11/2011

(Continued)

OTHER PUBLICATIONS

YKK; International Search Report and Written Opinion for PCT/JP2018/030466, filed Aug. 17, 2018, dated Oct. 10, 2018, 18 pgs.

*Primary Examiner* — Robert Sandy
(74) *Attorney, Agent, or Firm* — Taylor English Duma LLP

(57) ABSTRACT

A fastening device includes a first tape portion and a first fastening portion joined thereto, the first fastening portion defining a first side surface and a second side surface opposite thereto, the first fastening portion including a plurality of fastening elements extending from the first side surface, the plurality of fastening elements arranged lengthwise along a lengthwise direction of the fastening device, each adjacent pair of fastening elements offset by a pitch distance and defining a fastening gap therebetween, each of the plurality of fastening elements including an engagement portion extending in a direction parallel to the lengthwise direction, each of the plurality of fastening elements being asymmetric about a protrusional centerline of the fastening element, the fastening device being a first fastening device configured to be joined to a second fastening device comprising a second fastening portion having the same geometry as the first fastening portion.

18 Claims, 19 Drawing Sheets

(51) Int. Cl.
*A44B 19/26* (2006.01)
*A44B 19/32* (2006.01)

(56) References Cited

U.S. PATENT DOCUMENTS

| | | | | |
|---|---|---|---|---|
| 3,600,766 | A * | 8/1971 | Alberts | A44B 19/08 24/401 |
| 6,854,886 | B2 | 2/2005 | Piechocki et al. | |
| 2002/0164449 | A1 | 11/2002 | Fujisawa et al. | |
| 2002/0164451 | A1 | 11/2002 | Fujisawa et al. | |
| 2002/0184740 | A1 | 12/2002 | Meager | |
| 2008/0189913 | A1 | 8/2008 | Bergman et al. | |
| 2009/0010735 | A1 | 1/2009 | Gallant et al. | |
| 2009/0211852 | A1 | 8/2009 | Hannon et al. | |
| 2010/0303390 | A1 | 12/2010 | Ackerman et al. | |

FOREIGN PATENT DOCUMENTS

| | | |
|---|---|---|
| CN | 205795062 | 12/2016 |
| FR | 2684277 | 6/1993 |
| JP | S34-6609 | 5/1959 |
| JP | 3886965 | 2/2007 |
| JP | 2008540065 | 11/2008 |
| JP | 2009090128 | 4/2009 |
| JP | 2010510004 | 4/2010 |
| JP | 2010540075 | 12/2010 |
| JP | 2014531291 | 11/2014 |
| JP | 6066332 | 1/2017 |
| KR | 101237837 | 11/2012 |
| WO | 2008064170 | 5/2008 |
| WO | 2012009687 | 1/2012 |
| WO | 2013052742 | 4/2013 |

* cited by examiner

SLIDE FASTENER

TECHNICAL FIELD

Field of Use

This disclosure relates to fastening systems. More specifically, this disclosure relates to a fastening system for joining two fastening devices such as a pair of slide fasteners to each other.

Related Art

Fasteners are commonly used to join two panels of material, such as two panels of a piece of clothing, two panels of a piece of upholstery, or two different parts of packaging such as the sides of an opening of a sealed bag. With varying degrees of flexibility, typical slide fasteners are made from multiple components (e.g., metal, plastic, and fabric) and materials and as a result can be more costly to manufacture and even assemble to the end product. The prospect of being able to use a relatively low cost manufacturing process, such as an extrusion process with even multiple materials, to make many thousands of feet of fastener material is attractive but has not generally been practical due to the inflexibility and/or weakness of the resulting fastened joint.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a fastening system comprising: a first fastening device comprising a first fastening portion and a first tape portion joined to the first fastening portion, the first fastening portion comprising a base defining a first side surface and a second side surface opposite from the first side surface, the first fastening portion comprising a plurality of fastening elements extending from the first side surface of the base of the first fastening portion, the plurality of fastening elements arranged lengthwise along a lengthwise direction of the first fastening device, each adjacent pair of fastening elements offset by a pitch distance and defining a fastening gap therebetween, each of the plurality of fastening elements comprising an engagement portion extending in a direction parallel to the lengthwise direction of the first fastening device, the second side surface of the first fastening portion defining a plurality of relief grooves, the plurality of relief grooves substantially aligned in the lengthwise direction of the first fastening device with a fastening element of the first fastening portion of the first fastening device; and a second fastening device comprising a second fastening portion and a second tape portion joined to the second fastening portion, the second fastening portion comprising a base defining a first side surface and a second side surface opposite from the first side surface, the second fastening portion comprising a plurality of fastening elements extending from the first side surface of the base of the second fastening portion, the plurality of fastening elements arranged lengthwise along a lengthwise direction of the second fastening device, each adjacent pair of fastening elements offset by the pitch distance and defining a fastening gap therebetween, each of the plurality of fastening elements comprising an engagement portion extending in a direction parallel to the lengthwise direction of the second fastening device, the second side surface of the second fastening portion defining a plurality of relief grooves, the plurality of relief grooves substantially aligned in the lengthwise direction of the second fastening device with a fastening element of the second fastening portion of the second fastening device; wherein the second fastening portion of the second fastening device is configured to fasten to the first fastening portion of the first fastening device when the first side surface of the second fastening portion is facing the first side surface of the first fastening portion, each of a plurality of fastening gaps of the first fastening portion sized to lockably receive a one of the plurality of fastening elements of the second fastening portion and each of a plurality of fastening gaps of the second fastening portion sized to lockably receive a one of the plurality of fastening elements of the first fastening portion.

In a further aspect, disclosed is a fastening device comprising: a first tape portion; and a first fastening portion joined to the first tape portion, the first fastening portion defining a first side surface and a second side surface opposite from the first side surface, the first fastening portion comprising a plurality of fastening elements extending from the first side surface, the plurality of fastening elements arranged lengthwise along a lengthwise direction of the first fastening device, each adjacent pair of fastening elements offset by a pitch distance and defining a fastening gap therebetween, each of the plurality of fastening elements comprising an engagement portion extending in a direction parallel to the lengthwise direction of the first fastening device, each of the plurality of fastening elements being asymmetric about a protrusional centerline of the fastening element, the fastening device being a first fastening device, the first fastening device configured to be joined to a second fastening device comprising a second fastening portion having the same geometry as the first fastening portion of the first fastening device.

In yet another aspect, disclosed is a method of using a fastening system, the method comprising: obtaining a first fastening device, the fastening device comprising a first tape portion; and a first fastening portion joined to the first tape portion, the first fastening portion defining a first side surface and a second side surface opposite from the first side surface, the first fastening portion comprising a plurality of fastening elements extending from the first side surface, the plurality of fastening elements arranged lengthwise along a lengthwise direction of the first fastening device, each adjacent pair of fastening elements offset by a pitch distance and defining a fastening gap therebetween, each of the plurality of fastening elements comprising an engagement portion extending in a direction parallel to the lengthwise direction of the first fastening device, the second side surface of the first fastening portion defining a plurality of relief grooves, the plurality of relief grooves substantially aligned in the lengthwise direction of the first fastening device with a fastening element of the first fastening portion of the first fastening device; obtaining a second fastening device to a second panel, the fastening device comprising a second tape portion; and a second fastening portion joined to the second tape portion, the second fastening portion defining a first side surface and a second side surface opposite from the first side surface, the second fastening portion comprising a plurality of fastening elements extending from the first side surface, the plurality of fastening elements arranged lengthwise along a lengthwise direction of the second fastening device, each adjacent pair of fastening elements offset by a pitch distance and defining a fastening gap therebetween, each of the plurality of fastening elements comprising an engagement portion extending in a direction parallel to the lengthwise direction of the second fastening device, the second side surface of the second fastening portion defining a plurality of relief grooves, the plurality of relief grooves substantially aligned in the lengthwise direction of the second fastening device with a fastening element of the second fastening portion of the second fastening device; and fastening the second fastening portion of the second fastening device to the first fastening portion of the first fastening device when the first side surface of the second fastening portion is facing the first side surface of the first fastening portion, each of a plurality of fastening gaps of the first fastening portion sized to lockably receive a one of the plurality of fastening elements of the second fastening portion and each of a plurality of fastening gaps of the second fastening portion sized to lockably receive a one of the plurality of fastening elements of the first fastening portion.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 1:
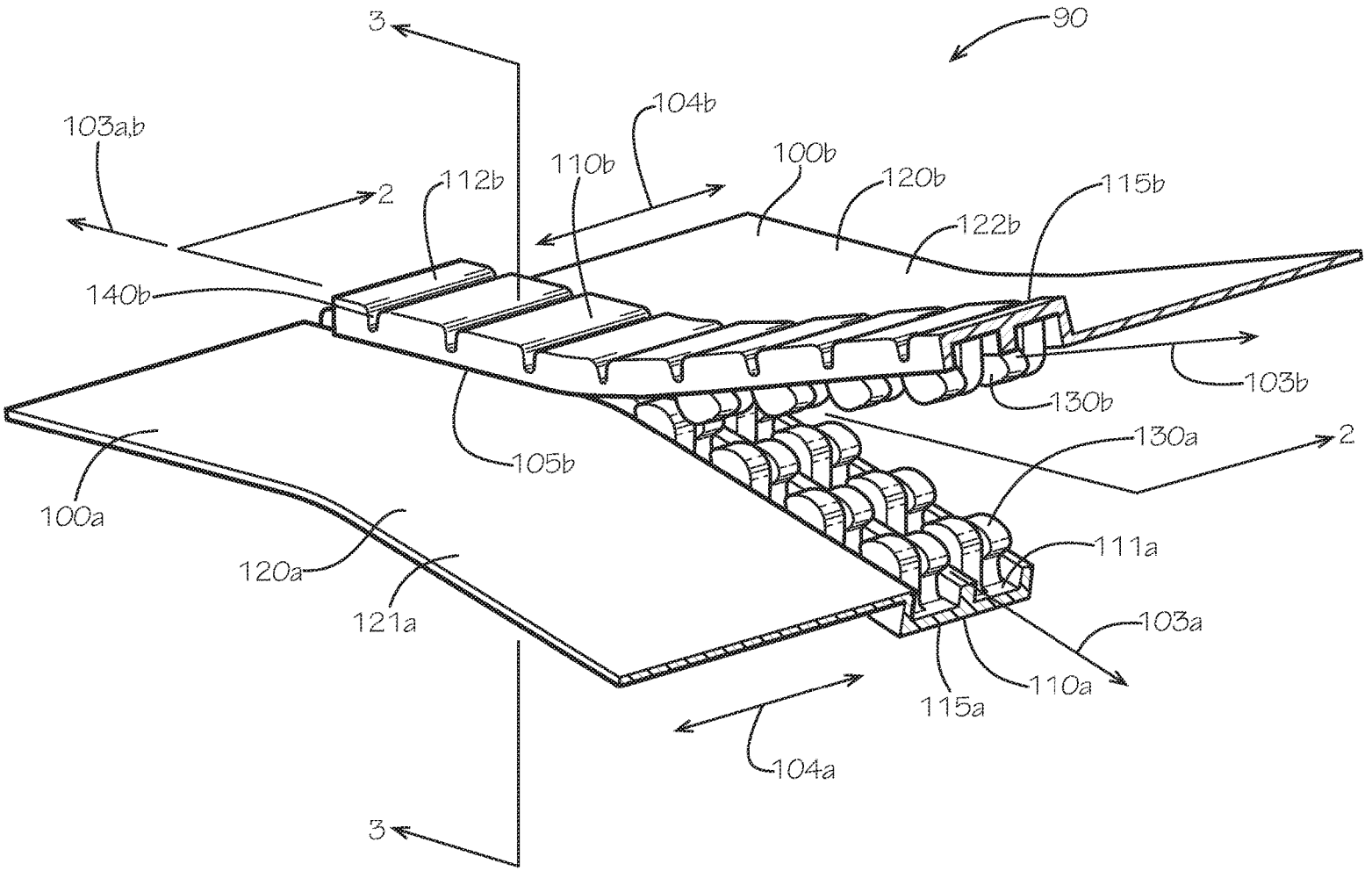
FIG. 1 is a perspective view of a fastening system comprising a first fastening device and a second fastening device in accordance with one aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise.

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list.

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that end of the fastening system nearest to a first longitudinal or lengthwise end of the fastening system; "rear" is that end of the seat that is opposite or distal the front; "left" is that which is to the left of or facing left while facing towards the front; and "right" is that which is to the right of or facing right while facing towards the front. "Horizontal" or "horizontal orientation" describes that which is in a plane extending from left to right and aligned with the horizon. "Vertical" or "vertical orientation" describes that which is in a plane that is angled at 90 degrees to the horizontal.

In various aspects, a fastening system and associated methods, systems, devices, and various apparatuses are disclosed herein. In some aspects, the fastening system can comprise a pair of fastening devices comprising a fastening portion and a tape portion.

FIG. 1 discloses a fastening system 90. The fastening system 90 can comprise a first fastening device 100*a* and a second fastening device 100*b*. Each of the fastening devices 100*a,b* can comprise a respective fastening portion 110*a,b* and a respective tape portion 120*a,b* joined to the fastening portion 110*a,b*.

Each of the fastening portions 110*a,b* can comprise a respective base 115*a,b* defining a respective first side surface 111*a,b* (111*b* shown in FIG. 2) and a respective second side surface 112*a,b* (112*a* shown in FIG. 2) opposite from the first side surface 111*a,b*. Likewise, each of the tape portions 120*a,b* can define a respective first side surface 121*a,b* (121*b* shown in FIG. 4) and a respective second side surface 122*a,b* (122*a* shown in FIG. 3) opposite from the first side surface 121*a,b*.

Each of the fastening portions 110*a,b* can comprise a plurality of respective fastening elements 130*a,b* extending from the respective first side surface 111*a,b* of the respective fastening portion 110*a,b*. More specifically, each of the plurality of fastening elements 130*a,b* can be arranged lengthwise along a respective lengthwise direction 103*a,b* of the respective fastening device 100*a,b*, where each lengthwise direction 103*a,b* generally runs parallel with a respective outer edge 105*a,b* (105*a* shown in FIG. 3) of the fastening device 100*a,b* and is angled at 90 degrees with respect to a respective transverse direction 104*a,b* of each fastening device 100*a,b*.

Figure 2:
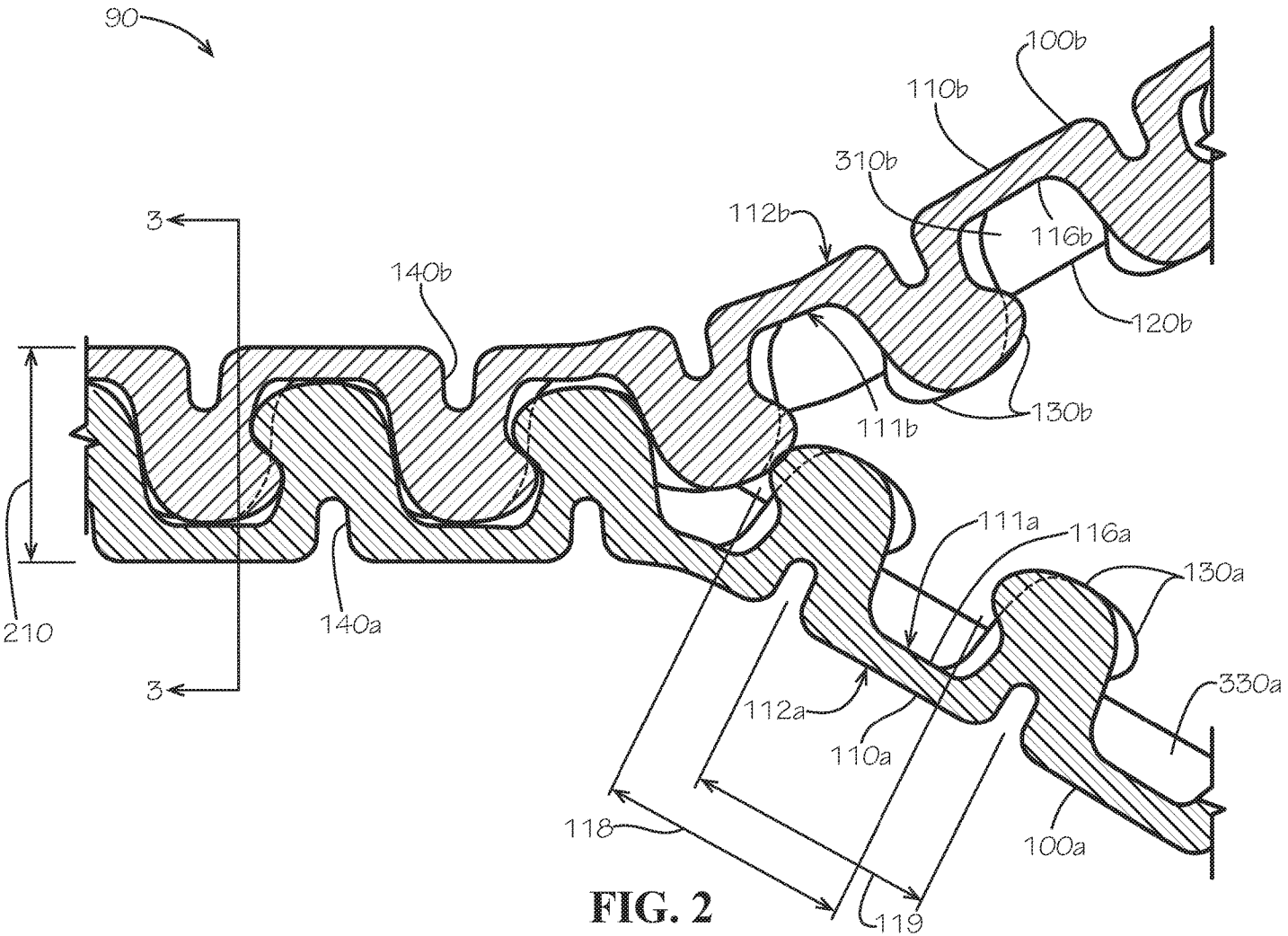
FIG. 2 is a sectional view of the fastening system of FIG. 1 taken along line 2-2 of FIG. 1.
Figure 3:
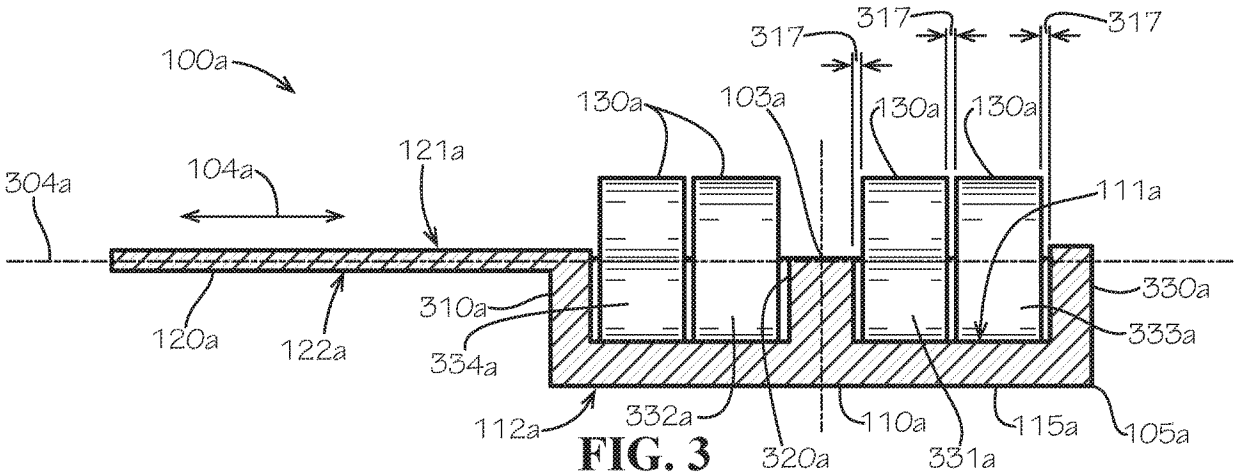
FIG. 3 is a sectional view of the first fastening device of the fastening system of FIG. 1 taken along line 3-3 of FIGS. 1 and 2 with the second fastening device removed for clarity.

As shown in FIG. 2, taken from a line 2-2 that goes through a row of fastening elements adjacent to the intermediate wall 320*a* shown, e.g., in FIG. 3, each adjacent pair of fastening elements 130*a,b*—i.e., each pair of fastening elements 130*a,b* positioned adjacent each other in the lengthwise direction 103*a,b*—can be offset by a fastening element pitch distance 118. Each adjacent pair of fastening elements 130*a,b* can define a fastening gap 116*a,b* therebetween. The second fastening portion 110*b* of the second fastening device 100*b* can be configured to fasten to the first fastening portion 110*a* of the first fastening device 100*a*, including when the first side surface 111*b* of the second fastening portion 110*b* is facing the first side surface 111*a* of the first fastening portion 110*a*. Specifically, the plurality of fastening gaps 116*a* of the first fastening portion 110*a* can be sized to lockably receive the plurality of fastening elements 130*b* of the second fastening portion 110*b*; and the plurality of fastening gaps 116*b* of the second fastening portion 110*b* can be sized to lockably receive the plurality of fastening elements 130*a* of the first fastening portion 110*a*. Together, the assembled first fastening device 100*a* and the second fastening device 100*b* can define a total assembled thickness 210.

The second side surface 112*a,b* of each of the fastening portions 110*a,b* can define a plurality of relief grooves 140*a,b* (140*a* shown in FIG. 2). The plurality of relief grooves 140*a,b* can be defined in the respective fastening portion 110*a,b* in a position that is substantially aligned in the lengthwise direction 103*a,b* of the respective fastening device 100*a,b* with the fastening element 130*a,b* of the fastening portion 110*a,b* of the fastening device 100*a,b*. When "substantially aligned," each relief groove 140*a,b* is defined in any lengthwise portion of the base 115*a,b* of the fastening portion 110*a,b* from which the fastening elements 130*a,b* extend. When "aligned," a center of each of the relief grooves 140*a,b* is aligned at least substantially with a center of each of the fastening elements 130*a,b*. Each adjacent pair of relief grooves 140*a,b* can be offset by a relief groove pitch distance 119. Each of the relief grooves 140*a,b* can extend across the fastening portion in the transverse direction 104*a,b*.

In some aspects, as shown, the plurality of fastening elements 130*a* of the first fastening device 100*a* can be formed monolithically with each other. Likewise, the plurality of fastening elements 130*b* of the second fastening device 100*b* can be formed monolithically with each other. In other aspects, the plurality of fastening elements 130*a* of the first fastening device 100*a* can be formed monolithically with the first tape portion 120*a*. Likewise, the plurality of fastening elements 130*b* of the second fastening device 100*b* can be formed monolithically with the second tape portion. 120*b*. In yet other aspects, the fastening portion 110*a,b* can be formed separately from the tape portion 120*a,b* and later joined to the tape portion 120*a,b*.

As shown in FIG. 3, the first fastening device 100*a* can define a transverse centerline 304*a* that is parallel to the transverse direction 104*a* and extends in a plane positioned halfway between the first side surface 121*a* and the second side surface 122*a* of the first tape portion 120*a*. Likewise, the second fastening device 100*b* can define a transverse centerline 304*b* (shown in FIG. 4) that is parallel to the transverse direction 104*b* and extends in a plane positioned halfway between the first side surface 121*b* and the second side surface 122*b* of the second tape portion 120*b*. In some aspects as will be discussed with respect to point symmetry, the first fastening device 100*a* is also representative of the second fastening device 100*b*.

Figure 4:
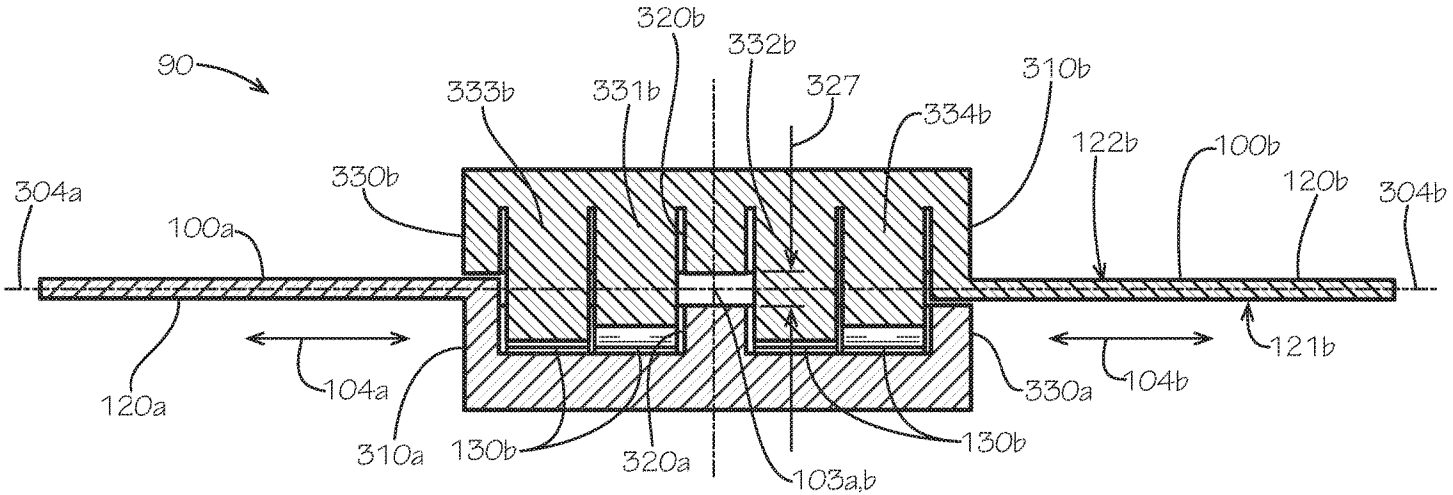
FIG. 4 is a sectional view of the fastening system of FIG. 1 taken along line 3-3 of FIGS. 1 and 2 showing both the first fastening device and the second fastening device in accordance with another aspect of the current disclosure.

Each of the fastening devices 100*a,b* can further comprise an inner wall 310*a,b* (310*b* shown in FIG. 4) joining the base 115*a,b* to the tape portion 120*a,b*, an outer wall 330*a,b* (330*b* shown in FIG. 4) distal from the inner wall 310*a,b*, and an intermediate wall 320*a,b* (320*b* shown in FIG. 4) positioned between the inner wall 310*a,b* and the outer wall 330*a,b*. In some aspects, as shown in FIG. 3, the intermediate wall 320*a* can extend from the base 115*a* and terminate at the transverse centerline 304*a*. In other aspects, as shown in FIG. 4, the intermediate wall 320*a* can terminate short of the transverse centerline 304*a* and respective intermediate walls 320*a,b* can define an intermediate wall gap 327 (shown in FIG. 4) therebetween when the fastening devices 100*a,b* are joined to each other. With the presence of the aforementioned walls (e.g., the inner wall 310*a,b*, the outer wall 330*a,b*, and the intermediate wall 320*a,b*), the crosswise strength of the fastening devices 100*a,b* against any load on the tape portions 120*a,b* in the transverse direction 104*a,b* can be improved, i.e., the likelihood of disengagement of the fastening devices 100*a,b* in the transverse direction 104*a,b* can be reduced.

In some aspects, as shown, a first row 331*a,b* (331*b* shown in FIG. 4) of fastener elements 130*a,b* and a second row 332*a,b* (332*b* shown in FIG. 4) of fastener elements 130*a,b* can be positioned on either side of the respective intermediate wall 320*a,b*. The fastener devices 100*a,b* can further comprise a third row 333*a,b* (333*b* shown in FIG. 4) of the fastening elements 130*a,b* and a fourth row 334*a,b* (334*b* shown in FIG. 4) of the fastening elements 130*a,b*. Any two of the first row 331*a,b*, the second row 332*a,b*, the third row 333*a,b*, and the fourth row 334*a,b* of the fastening elements 130*a,b* can be aligned in the lengthwise direction 103*a,b* of the fastening device 100*a,b* and positioned parallel to each other. The third row 333*a,b* of the fastening elements 130*a,b* can be substantially aligned in the lengthwise direction 103*a,b* of the fastening devices 100*a,b* and positioned adjacent to and offset from the first row 331*a,b* of the fastening elements 130*a,b* of the respective fastening device 100*a,b* in a direction extending away from the second row 332*a,b* of the fastening elements 130*a,b*, and the fourth row 334*a,b* of the fastening elements 130*a,b* can be substantially aligned in the lengthwise direction 103*a,b* of the fastening devices 100*a,b* and positioned adjacent to and offset from the second row 332*a,b* of the fastening elements 130*a,b* of the fastening device 100*a,b* in a direction extending away from the first row 331*a,b* of the fastening elements 130*a,b*.

As shown, each fastening element 130*a,b* of the first row 331*a,b*, the second row 332*a,b*, the third row 333*a,b* and the fourth row 334*a,b* can be offset from any neighboring wall—e.g., the inner wall 310*a*, the intermediate wall 320*a*, or the outer wall 330*a,b*—by a lateral gap distance 317. For example and without limitation, the first row 331*a,b* of the fastening elements 130*a,b* and the intermediate wall 320*a,b* can define a lateral gap distance 317, and likewise the first row 331*a,b* of the fastening elements 130*a,b* and the third row 333*a,b* can define a lateral gap distance 317. While the presence of any of the inner wall 310*a*, the intermediate wall 320*a*, or the outer wall 330*a,b* can restrict movement of the second fastening device 100*b* with respect to the first fastening device 100*a*, the lateral gap distance 317 can help decrease the need for the accurate alignment of the first fastening device 100*a* and the second fastening device 100*b* in the transverse directions 104*a,b*.

Figure 6:
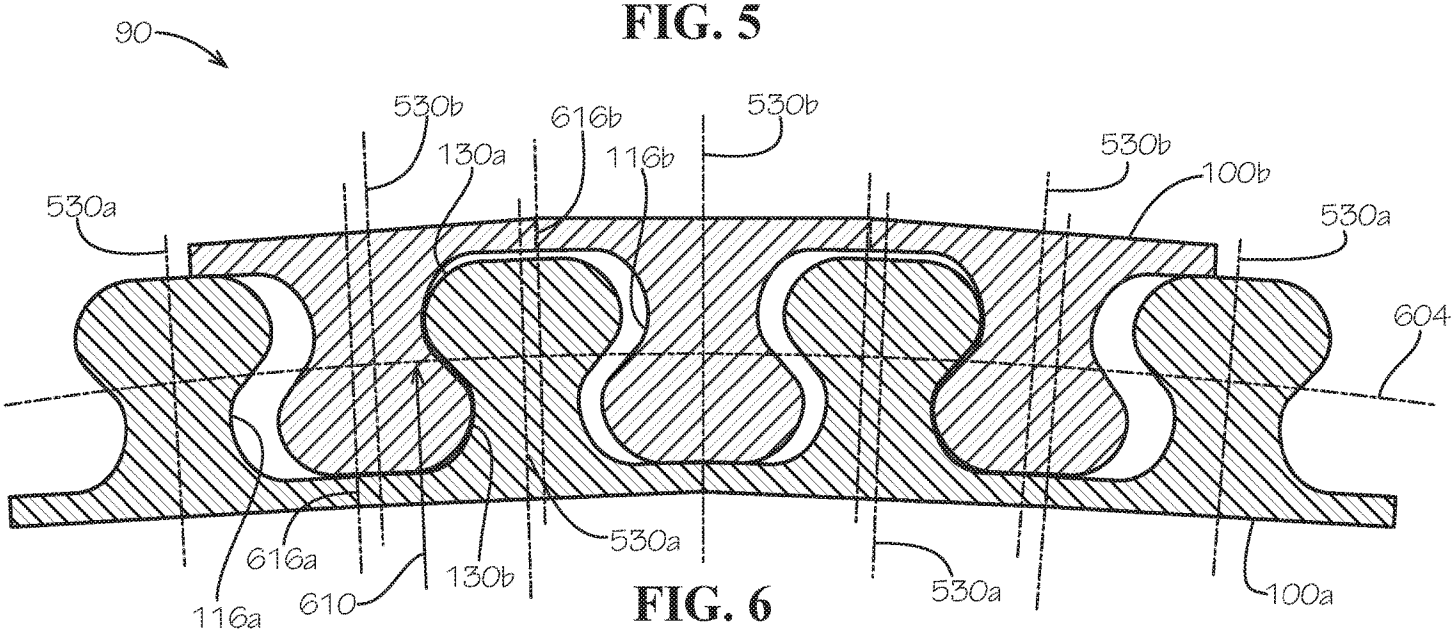
FIG. 6 is a sectional view of the fastening system of FIG. 1 in a bent condition in accordance with another aspect of the current disclosure, the fastening system comprising a first fastening device and a second fastening device each comprising a plurality of fastening elements matching the geometry of FIG. 5.
Figure 8:
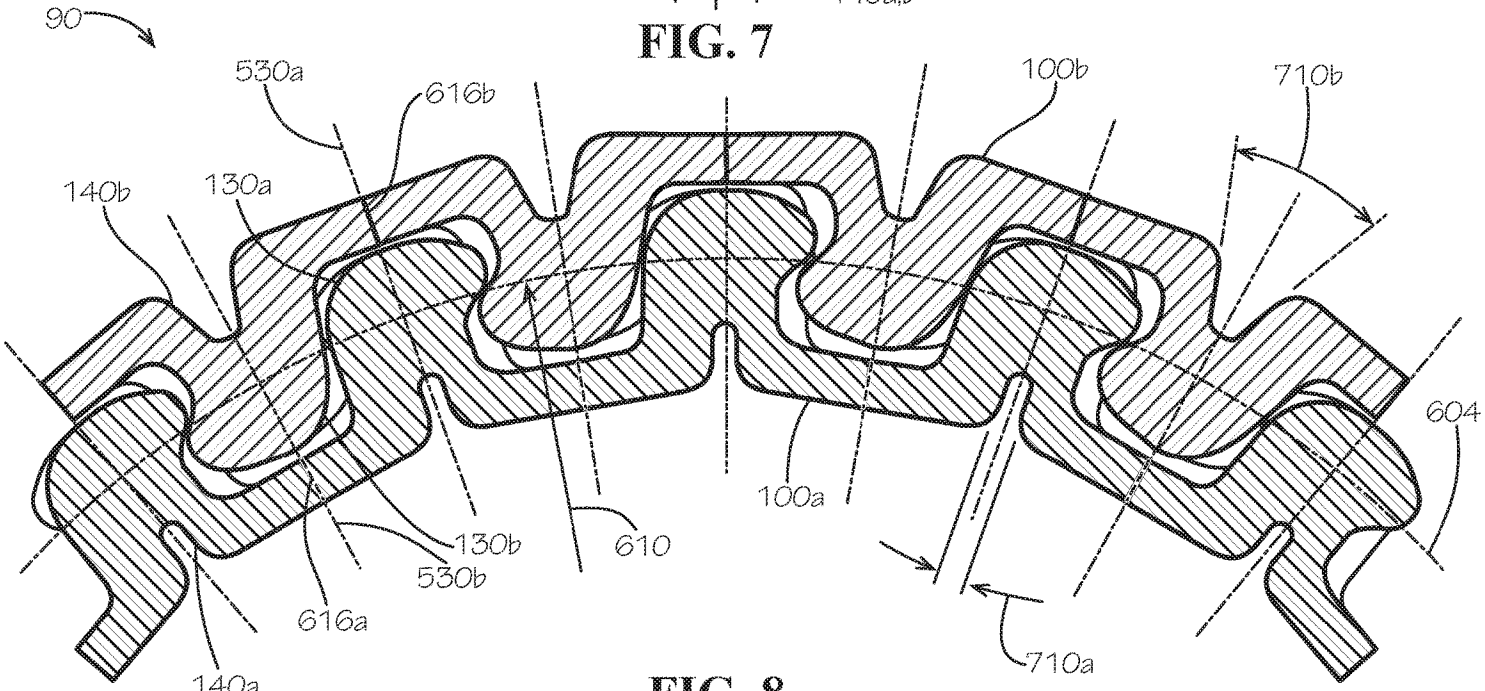
FIG. 8 is a sectional view of the fastening system of FIG. 1 in a bent condition and in accordance with another aspect of the current disclosure.

In some aspects, as shown in FIG. 4, the first tape portion 120*a* and the second tape portion 120*b* can be made substantially coplanar when the fastening portions 110*a,b* are engaged to each other. More specifically, the transverse centerline 304*a* of the first tape portion 120*a* can be made at least substantially coplanar with the transverse centerline 304*b* of the second tape portion 120*b*. With this coplanar orientation or arrangement, bending of the fastening system 90 as shown in FIGS. 6 and 8 and application of any load on the tape portions 120*a,b* in the transverse direction 104*a,b* is less likely to cause non-uniform bending of the fastening system 90 or twisting of the connection between the fastening devices 120*a,b*. More specifically, a longitudinal centerline 604 (shown in FIGS. 6 and 8) of the bent joint of the fastening system 90 can in the process be made coincident or coplanar with the transverse centerlines 304*a,b*.

Figure 5:
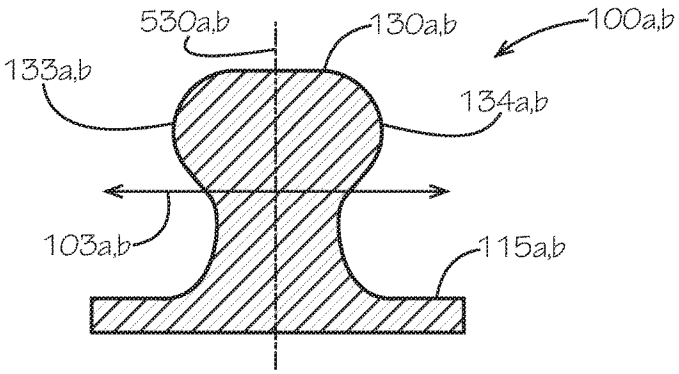
FIG. 5 is a sectional view of a fastening element of the fastening system of FIG. 1 in accordance with another aspect of the current disclosure, wherein the fastening element is symmetric about a protrusional centerline of the fastening element.
Figure 7:
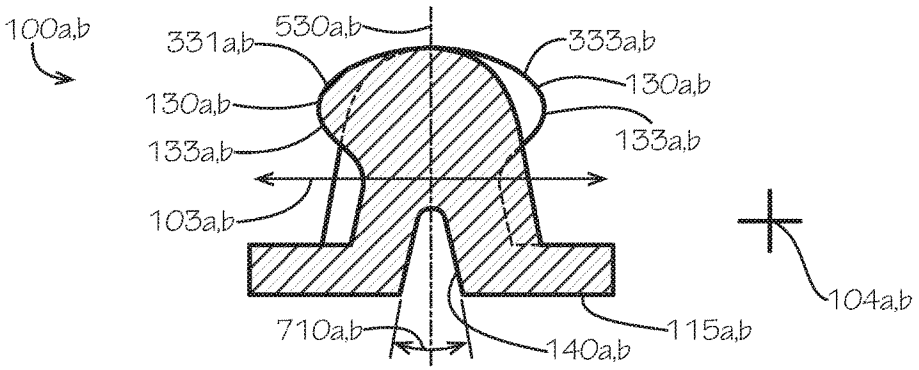
FIG. 7 is a sectional view of the fastening element of the fastening system of FIG. 1, wherein the fastening element is asymmetric about the protrusional centerline of the fastening element.

In some aspects, as shown in FIG. 5, each fastening element 130*a,b* of the fastening device 100*a,b* can comprise an engagement portion 133*a,b* and an engagement portion 134*a,b* extending in a direction parallel to the lengthwise direction 103*a,b* of the fastening device 100*a,b*. In some aspects, each of the engagement portions 133*a,b*,134*a,b* can comprise a hook, as shown in FIGS. 5 and 7. A hook is any shape extending in a specified direction (in the aforementioned aspect, the lengthwise direction 103*a,b*) that either extends past a portion of a base of the corresponding fastening element 130*a,b* in the specified direction such that the hook would tend to catch on the hook of a mating fastener device or is otherwise configured to catch on a mating fastener device. In other aspects, each of the engagement portions 133*a,b*,134*a,b* need not comprise a hook. Extension of the fastening element 130*a,b* past the base of the fastening element 130*a,b* to create the engagement portion 133*a,b* or the engagement portion 134*a,b* can create an undercut or relief between the engagement portion 133*a,b*,134*a,b* and the base 115*a,b* as shown that, among other unique features of the fastening system 90, can be molded through various exemplary methods as will be described. As shown, the fastening element 130*a,b* can be made symmetric about a protrusional centerline 530*a,b* of the fastening element 130*a,b*. In some aspects, as shown, the fastening device 100*a,b* need not define the aforementioned relief groove 140*a,b*. In other aspects, the fastening device 100*a,b* can comprise a plurality of fastening elements 130*a,b* having symmetry about the protrusional centerline 530*a,b*, each defining the relief groove 140*a,b* and exhibiting the same level of flexibility shown below with fastening elements 130*a,b* having an asymmetric shape.

As shown in FIG. 6, when the first fastening device 100*a* is joined to the second fastening device 100*b* and the resulting fastening system 90 is bent as shown, interference between the fastening elements 130*a,b* prevents bending of the fastening system 90 below a minimum bend radius 610. As shown, even when each of the fastening devices 100*a,b* is formed from a resilient or flexible material, the rigidity of each segment of the fastening devices 100*a,b* restricts the flexibility of the assembled fastening system 90, where each segment can comprise a single fastening element 130*a,b* extending in the lengthwise direction 103*a,b*. Even relatively slight bending of the fastening system 90 causes misalignment between each of the protrusional centerlines 530*a,b* and a corresponding centerline 616*a,b* of each fastening gap 116*a,b*.

In other aspects, as shown in FIG. 7, each fastening element 130*a,b* of the fastening device 100*a,b* can be made asymmetric about the protrusional centerline 530*a,b* of the fastening element 130*a,b*. In some aspects, as shown, each fastening device 100*a,b* can define the aforementioned relief groove 140*a,b* proximate to each fastening element 130*a,b*. The relief groove 140*a,b* can define a tapered opening when viewed in cross-section along the transverse direction 104*a,b*. The tapered opening of the relief groove 140*a,b* can define an open angle 710*a,b*.

As shown in FIG. 8, when the first fastening device 100*a* is joined to the second fastening device 100*b* and the resulting fastening system 90 is bent as shown, bending to the bend radius 610 is not limited by interference between the fastening elements 130*a,b*. As shown, especially when each of the fastening devices 100*a,b* is formed from a resilient or flexible material, the flexibility of each segment of the fastening devices 100*a,b* makes it possible to maintain alignment between each of the protrusional centerlines 530*a,b* and the corresponding centerline 616*a,b* of each fastening gap 116*a,b*. For example, as shown, the open angle 710*b* of each of the relief grooves 140*b* of the second fastening device 100*b* can open up or increase as needed, and likewise the open angle 710*a* of each of the relief grooves 140*a* of the first fastening device 100*a* can close up or decrease as needed—even to a negative value until each of the relief grooves 140*a* closes completely on itself. Accordingly, the geometry of each of the relieve grooves 140*a,b* can be adjusted to allow for more or less bending of the fastening system 90 without disengagement of the fastening devices 100*a,b* from each other. Disengagement of the fastening devices 100*a,b* from each other can be a consequence of a fastening system that is not configured to be bent to the desired bend radius 610, at least when the force to overcome the interference between mating engagement portions 133*a,b* is less than the force to deform the engagement portions 133*a,b* or other portions of the fastening devices 100*a,b*, which itself can lead to accelerated disengagement.

The engagement portions 133*a,b* can be arranged in more than one direction or orientation on a fastening device 100*a,b*. As shown in the fastening system 90 of FIG. 8, an inner row (i.e., the row shown in cross-section) can extend to the right as shown, and an outer row can extend to the left. As shown in the fastening system 90 of FIG. 2, the directions in which the inner and outer rows extend can be reversed. When incorporated into the fastening system 90, the aforementioned asymmetry or symmetry of the fastening elements 130*a,b* about the corresponding protrusional centerline 530*a,b* can be used to ensure that two panels to be joined (not shown) can only be assembled in one orientation—for example and without limitation, when the orientation of the mating fastening devices is in matching alignment. As will be described, however, it is also possible for a fastening device exhibiting "point symmetry" to be assembled in more than one orientation.

Figure 9:
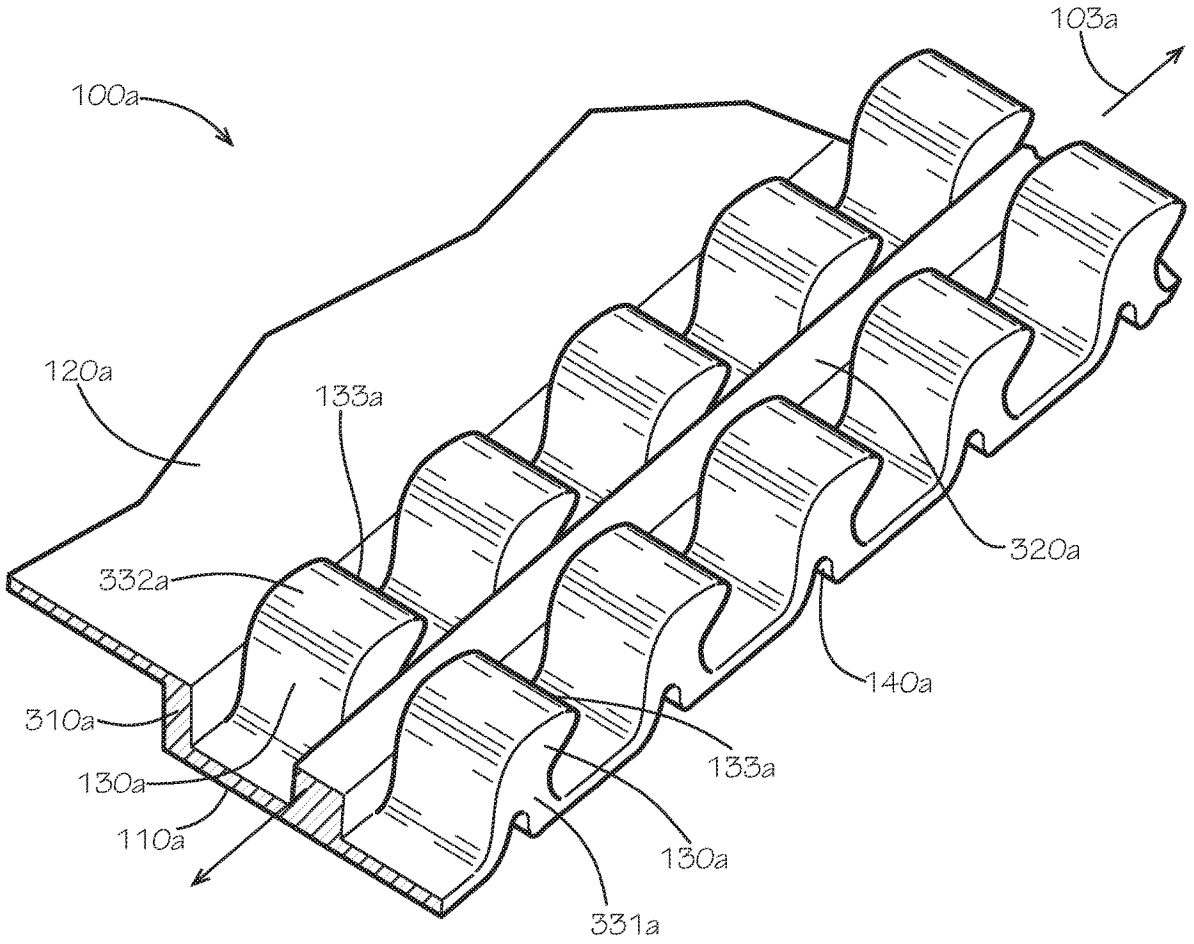
FIG. 9 is a perspective view of the first fastening device of FIG. 1 comprising a first row of fastening elements, a second row of fastening elements, and a wall therebetween in accordance with another aspect of the current disclosure.

As shown in FIG. 9, the first row 331*a* of the fastening elements 130*a* and the second row 332*a* of the fastening elements 130*a* can comprise the engagement portion 133*a*, and each of the engagement portions 133*a* can be made to extend in the same lengthwise direction 103*a*. Additionally, a fastening device such as the first fastening device 100*a* need not include the outer wall 330*a*. In some aspects, as shown, each fastening element 130*a* in the first row 331*a* is aligned in the same position along the lengthwise direction 103*a* as a neighboring fastening element 130*a* in the second row 332*a*. In other aspects, as shown and in any other aspect comprising more than one row such as the first row 331*a*, one or more fastening elements 130*a* in the first row 331*a* can be offset in the lengthwise direction 103*a* from the closest neighboring fastening element 130*a* in the second row 332*a*.

Figure 10:
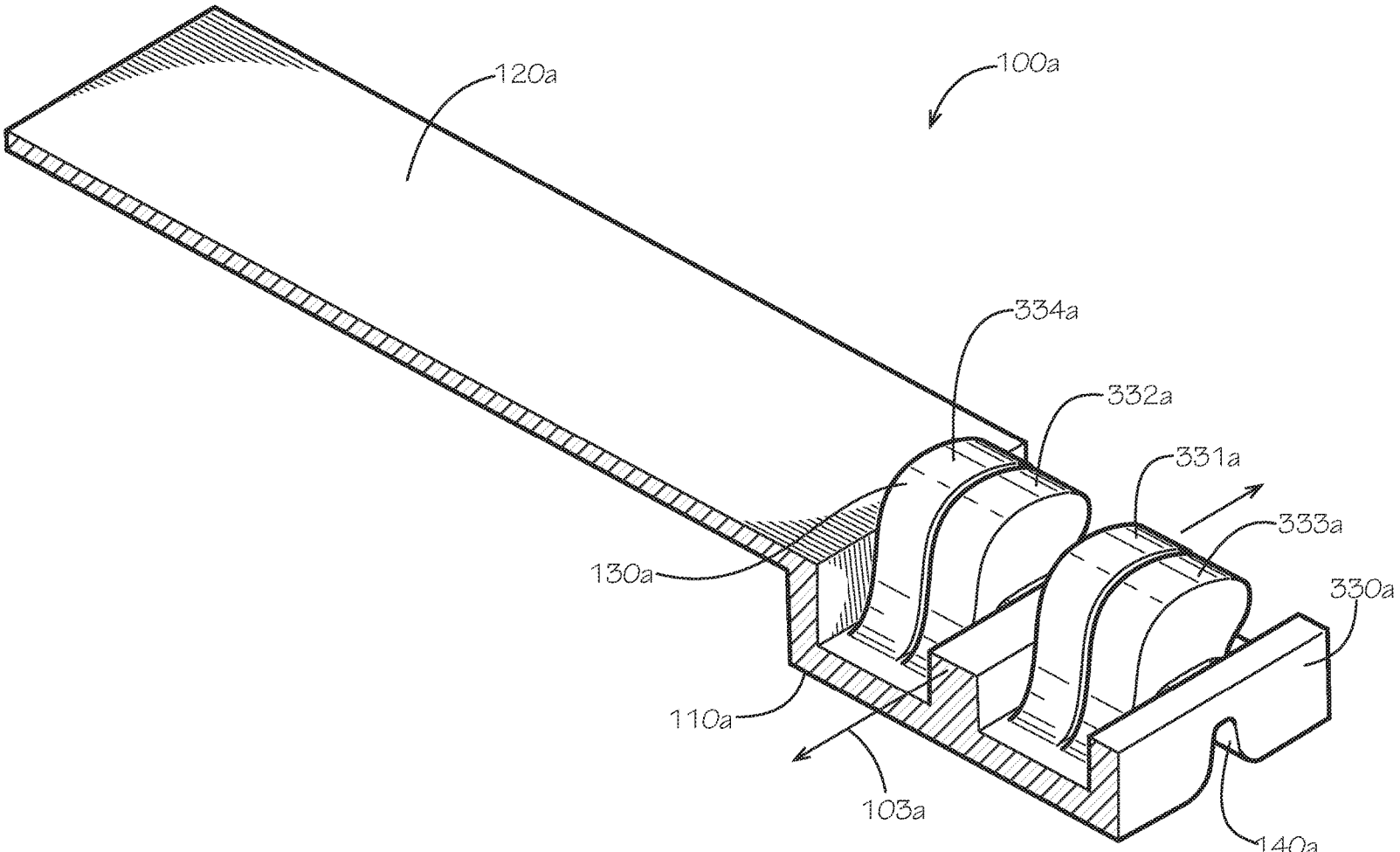
FIG. 10 is a perspective view of a segment of the first fastening device of FIG. 1 comprising a single fastening element of each of four rows of fastening elements in accordance with another aspect of the current disclosure.

As shown in FIG. 10, each of the engagement portions 133*a* of the fastening elements 130*a* of the first row 331*a*, the second row 332*a*, the third row 333*a*, and the fourth row 334*a* can be made to extend in the same lengthwise direction 103*a*.

Figure 11:
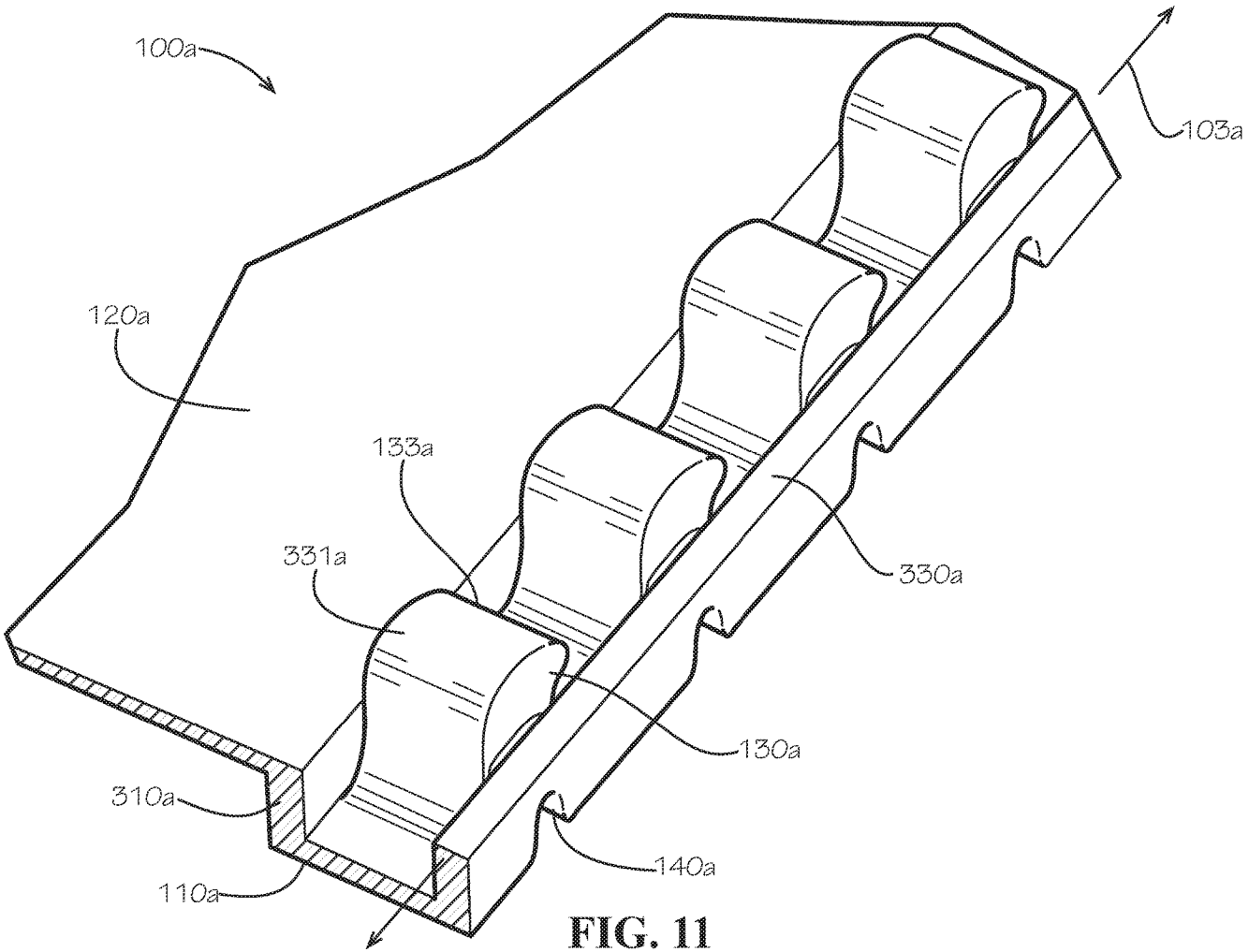
FIG. 11 is a perspective view of a segment of the first fastening device of FIG. 1 comprising only a first row of fastening elements in accordance with another aspect of the current disclosure.

As shown in FIG. 11, the first fastening device 100*a* can comprise only a single row of fastening elements 130*a* bounded by the inner wall 310*a* and the outer wall 330*a*.

Figure 12:
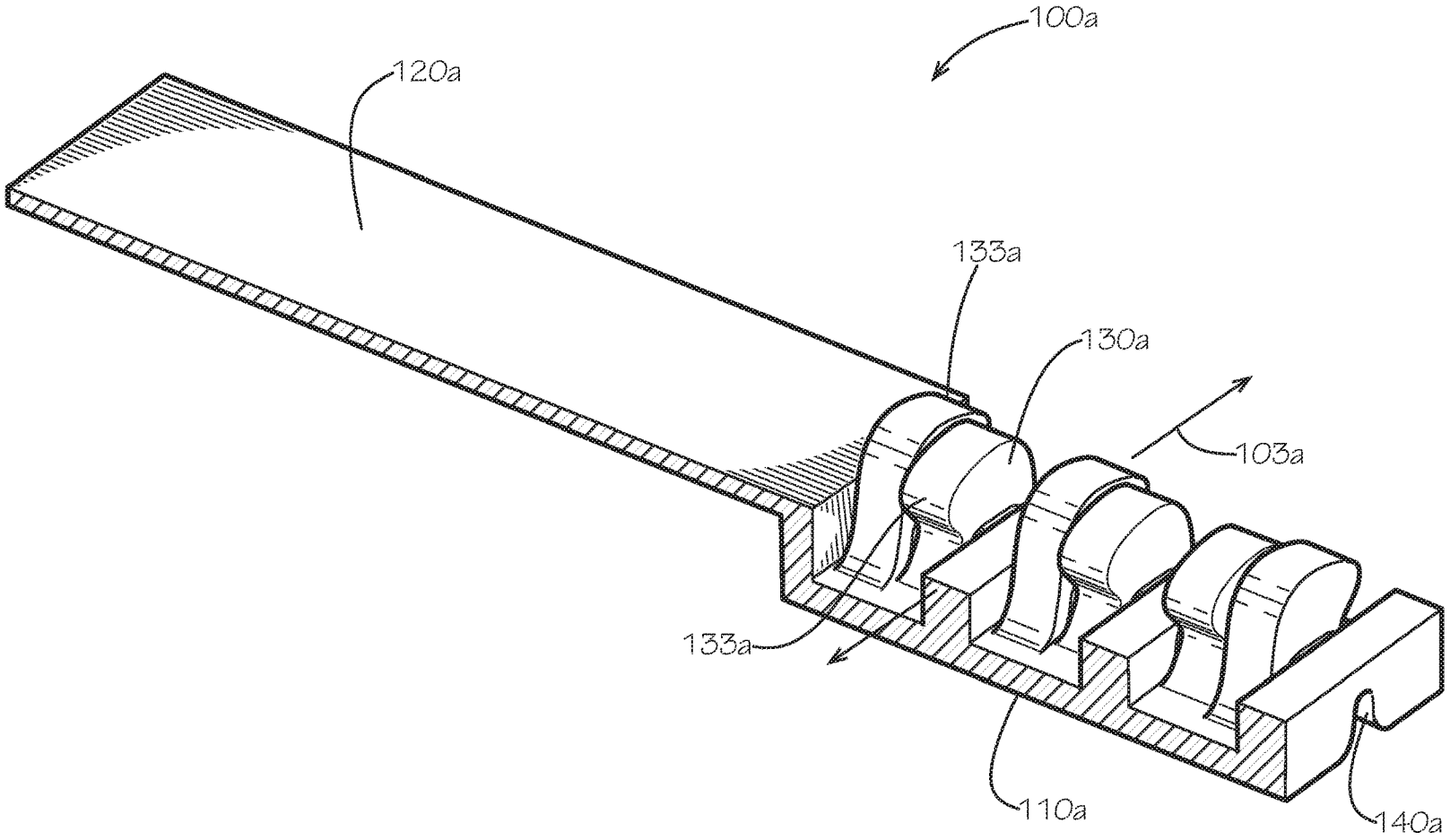
FIG. 12 is a perspective view of a segment of the first fastening device of FIG. 1 comprising a single fastening element of each of six rows of fastening elements in accordance with another aspect of the current disclosure.

In some aspects, as shown in FIG. 12, similarly to that shown in FIG. 1, the engagement portions 133*a* of the fastening elements 130*a* in adjacent rows of the fastening elements 130*a* can be made to extend in opposite directions along the lengthwise direction 103*a*. In other aspects, the engagement portions 133*a,b* can extend in a direction that is angled with respect to, but not necessarily in an opposite direction from, the direction in which the engagement portions 133*a,b* of the plurality of the fastening elements 130*a,b* in the first row 331*a.b* of the fastening elements 130*a,b* of the respective fastening device 100*a,b* extend. Fastening devices 100*a,b* comprising rows of fastening elements with engagement portions extending in more than one direction can improve engagement strength and can also improve crosswise strength due to the geometry of the engagement portions 133*a,b* extending in one direction interfering with the geometry of the engagement portions 133*a,b* extending in another direction.

Each of the fastening devices 100*a,b* can comprise any number of rows. For example and without limitation, a fastening portion 110*a* of the fastening device 100*a* can comprise six rows or more of the fastening elements 130*a*.

Increasing the number of rows can likewise improve engagement strength and crosswise strength.

Figure 13:
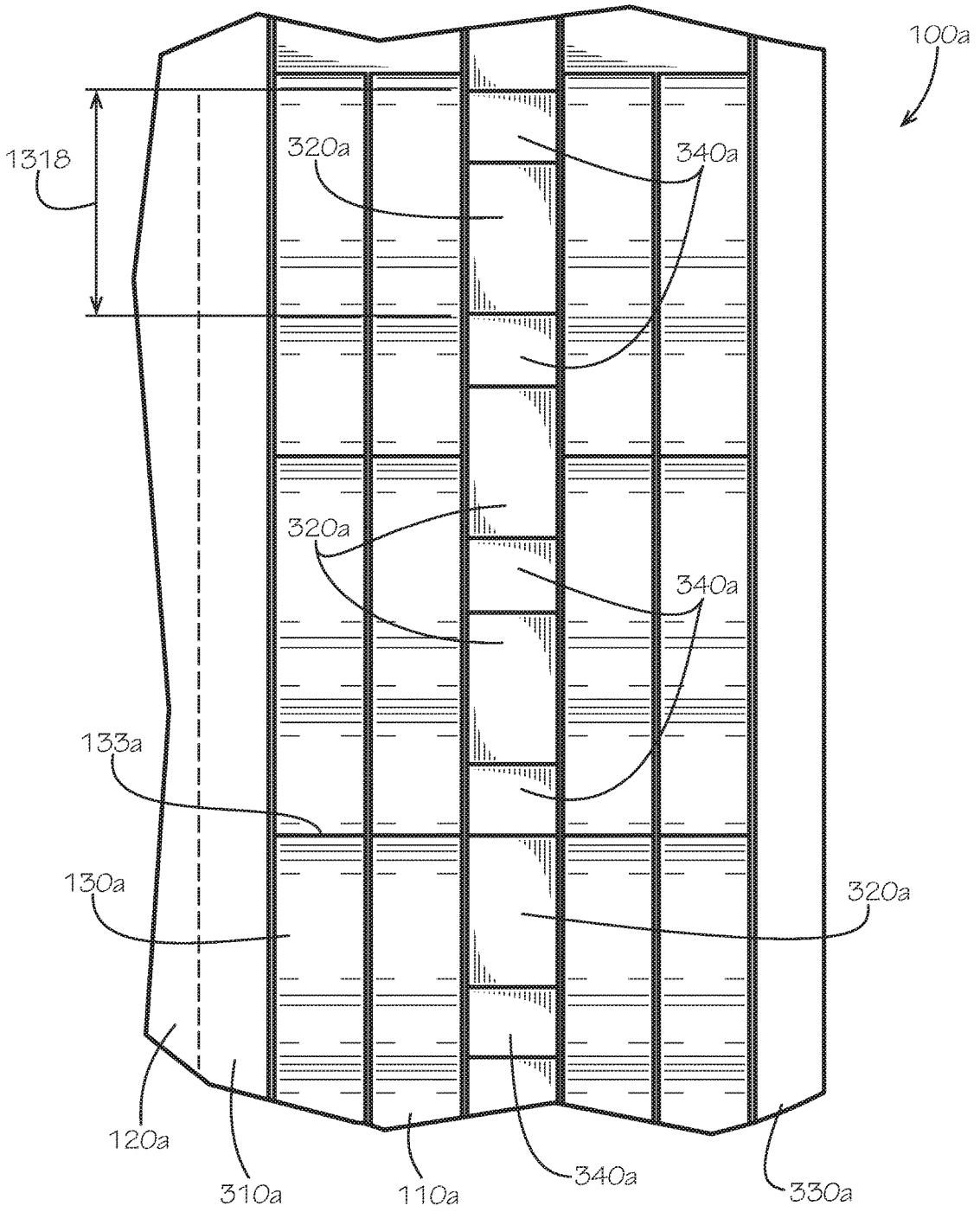
FIG. 13 is a top view of the first fastening device of FIG. 10 in accordance with another aspect of the current disclosure and comprising a segmented wall.
Figure 14:
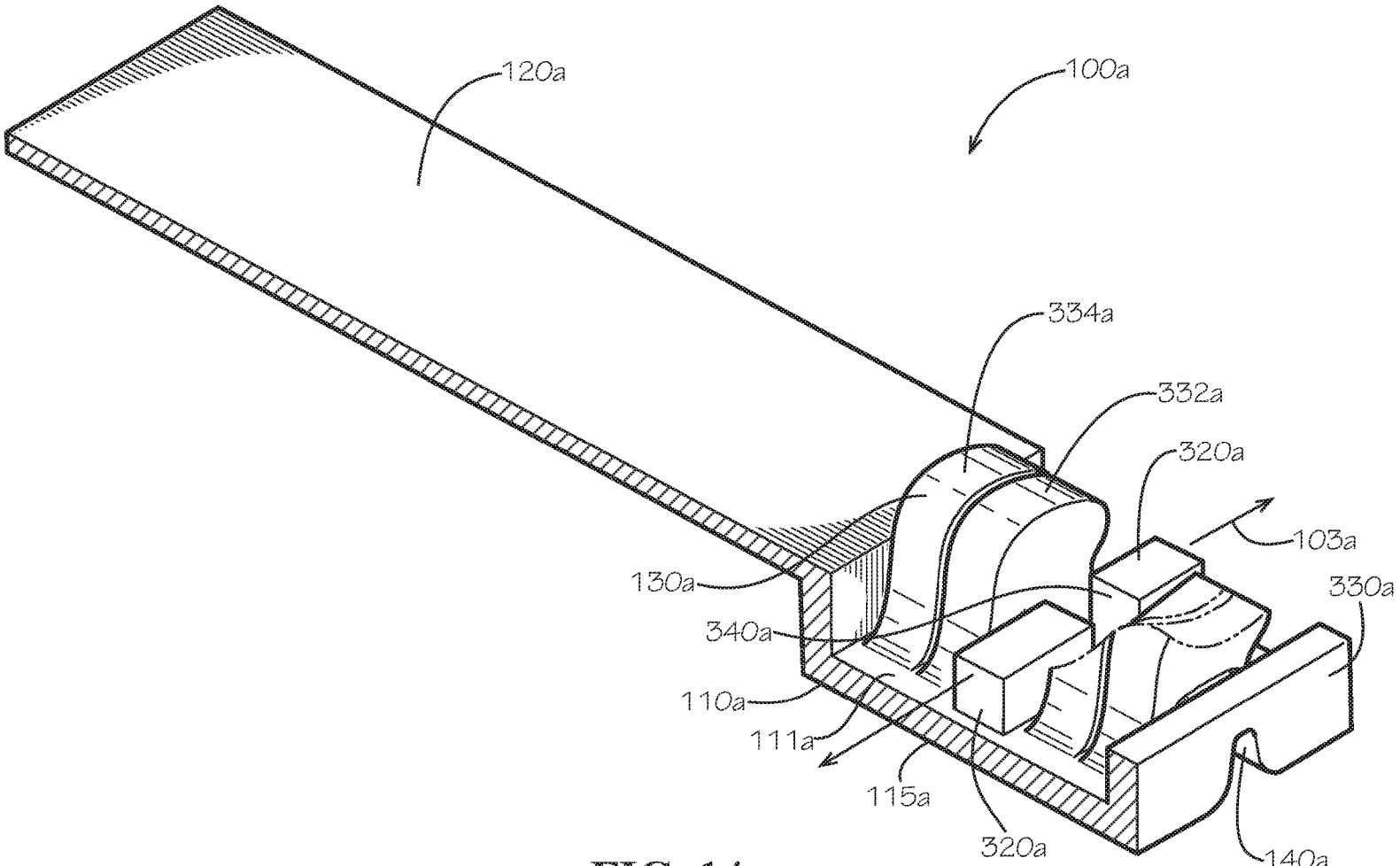
FIG. 14 is a partial cutaway perspective view of the first fastening device of FIG. 13.

In other aspects, as shown in FIGS. 13 and 14, a wall of the fastening device 100*a* such as, for example and without limitation, the intermediate wall 320*a* can be segmented instead of continuous. A wall 320*a* that is "segmented" defines breaks or wall gaps 340*a,b* (340*b* not shown) at which points the wall 320*a* is reduced in height or disappears and can define a segmented wall pitch 1318 offsetting the segments of the wall 320*a* from one another. A segmented wall can further increase the flexibility of the fastening portion 110*a,b* of the fastening device 100*a,b*. In some aspects, the segmented wall pitch 1318 can be different than the fastening element pitch distance 118. In other aspects, the segmented wall pitch 310 can equal the fastening element pitch distance 118 or the relief groove pitch distance 119.

Figure 15:
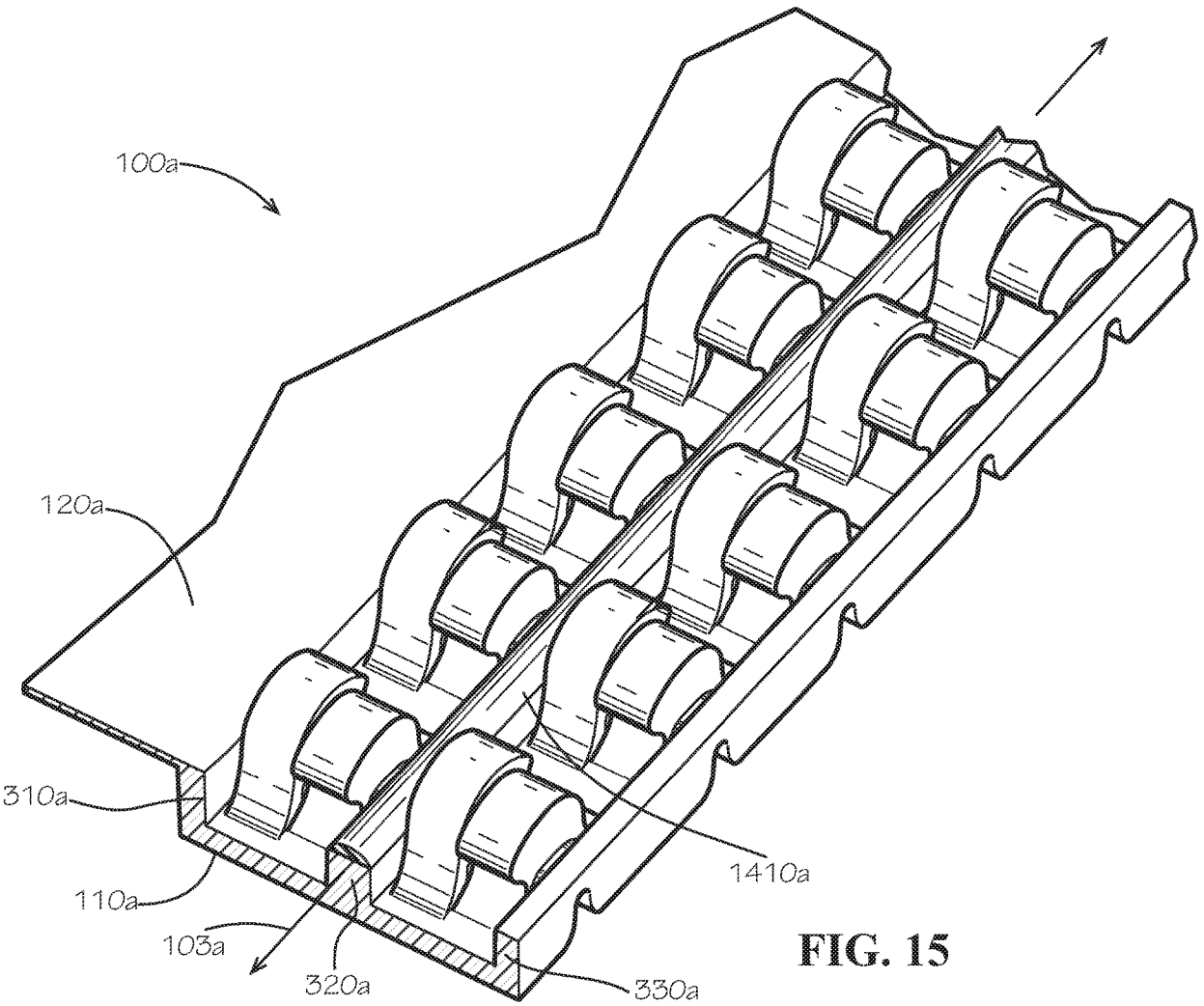
FIG. 15 is a perspective view of the first fastening device of FIG. 1 comprising two pairs of rows of fastening elements and a wall therebetween comprising a seal in accordance with another aspect of the current disclosure.
Figure 16:
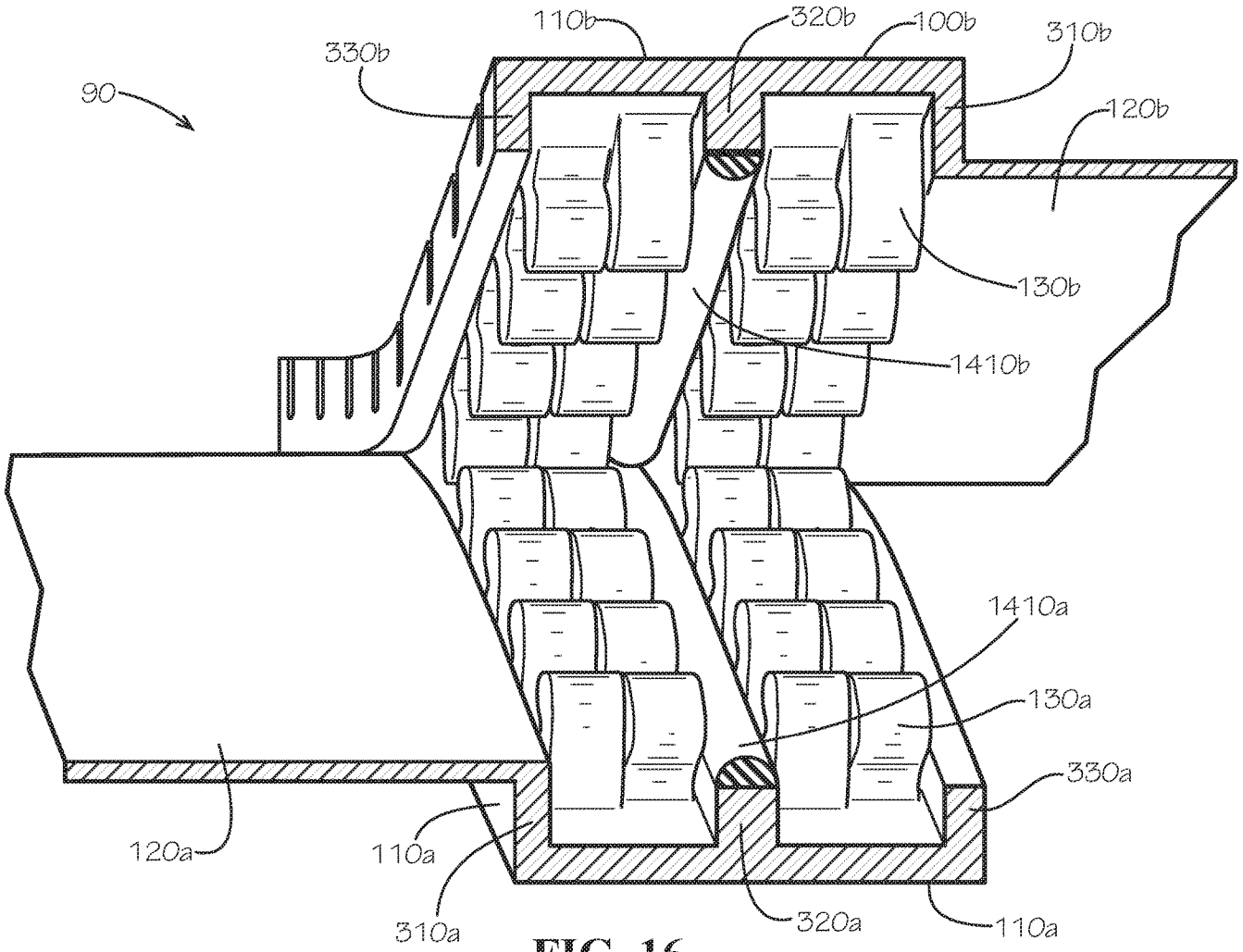
FIG. 16 is a perspective view of a fastening system comprising the first fastening device of FIG. 15 and a second fastening device having the same geometry as the first fastening device.
Figure 17:
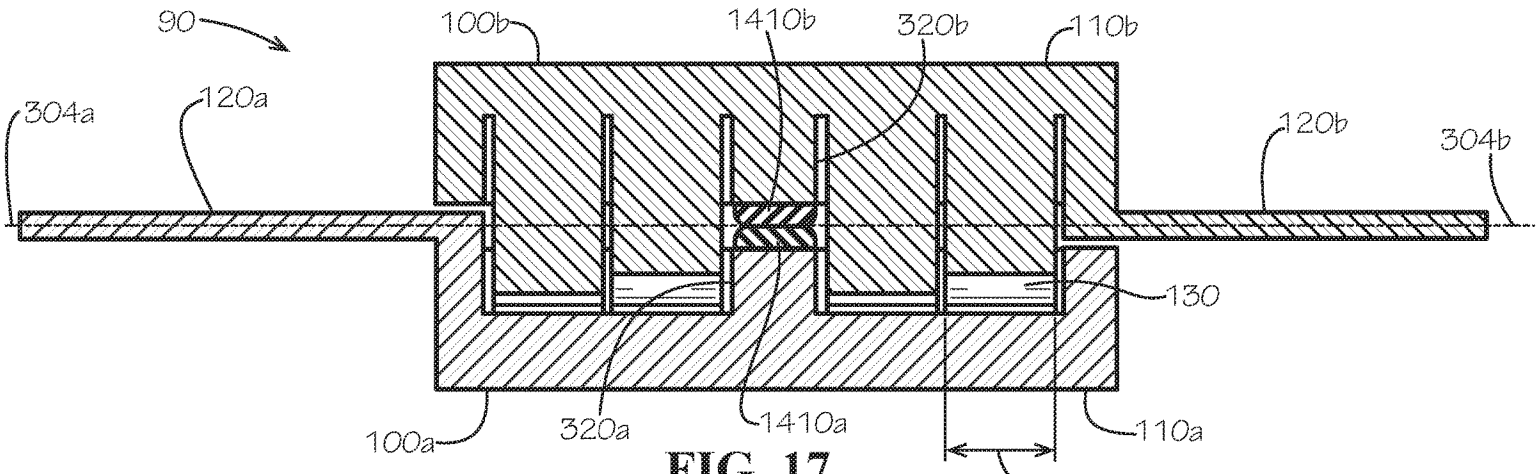
FIG. 17 is a sectional view of the fastening system of FIG. 16 taken from a comparable section as along line 3-3 in FIGS. 1 and 2.

As shown in FIGS. 15-17, a wall such as the intermediate wall 320*a* of the fastening portion 110*a* can comprise a seal 1410*a*. The seal 1410*a* can be configured to create a compressible and watertight seal against the second fastening device 100*b* during assembly of the second fastening device 100*b* with the first fastening device 100*a*. For example and without limitation, a height of the seal 1410*a* can be made higher than the space available for the seal 1410*a* in the assembled fastening system 90. Additionally, the seal 1410*a* can be made from a material having a lower durometer (i.e., hardness) such that the material compresses under the pressures experienced during assembly of the fastening devices 110*a,b*. As shown in FIG. 15, the seal 1410*a* can extend the length of the intermediate wall 320*a*. In some aspects, as shown in FIGS. 16 and 17, the intermediate wall 320*b* of the second fastening device 100*a* can comprise a seal 1410*b* to seal against the seal 1410*a* of the first fastening device 100*a*. In other aspects, only one of the intermediate walls 320*a,b* comprises the seal 1410*a* or the seal 1410*b*, in which case the seal 1410*a* or the seal 1410*b* that is present can seal against the intermediate wall 320*b* or the intermediate wall 320*a*, respectively. In other aspects not shown, either or both of the inner wall 310*a,b* or the outer wall 330*a,b* of the respective fastening device 100*a,b* can comprise a seal.

In some aspects, as shown, the seal can have a semicircular shape in cross-section that can progressively resist compression due to the increasingly larger sealing surface area during the compression process. In other aspects, the seal 1410*a,b* can have a rectangular shape in cross-section. In yet other aspects, the seal 1410*a,b* can have any other desirable shape including, for example and without limitation, a triangular shape. In some aspects, the seal 1410*a,b* can have a solid cross-section. In other aspects, the seal 1410*a,b* can be hollow. In some aspects, as shown, the seals 1410*a,b* can be symmetrical about the centerline 304*a* and can oppose one another. A watertight seal between the seals 1410*a,b* can thereby be effectuated by a compression force acting on each of the seals 1410*a,b* in the same direction in which they come together (i.e., towards the respective first side surface 111*a,b* of each fastening portion 110*a,b* or in a direction that is normal to the respective first side surface 111*a,b*). In other aspects, the seals 1410*a,b* can be offset such that the seal 1410*b* slides past the seal 1410*a* during engagement of the fastening portion 110*b* with the fastening portion 110*a*. A side surface of each of the seals 1410*a,b* can thereby face each other and seal against one another. A watertight seal between the seals 1410*a,b* can thereby be effectuated by a compression force acting at least partly on the side surface of each of the seals 1410*a,b* in the transverse directions 104*a,b* (shown in FIG. 4). In yet other aspects, one or both seals 1410*a,b* can comprise facing angled or tapered surfaces that meet and seal during engagement of the fastening portion 110*b* with the fastening portion 110*a*. Again, a side surface of each of the seals 1410*a,b* can thereby face each other and seal against one another. A watertight seal between the seals 1410*a,b* can also thereby be effectuated by a component of a compression force acting on the side surface of each of the seals 1410*a,b* in the transverse directions 104*a,b* and a component of a compression force acting on the side surface of each of the seals 1410*a,b* in a direction that is normal to the respective first side surface 111*a,b*.

Figure 18:
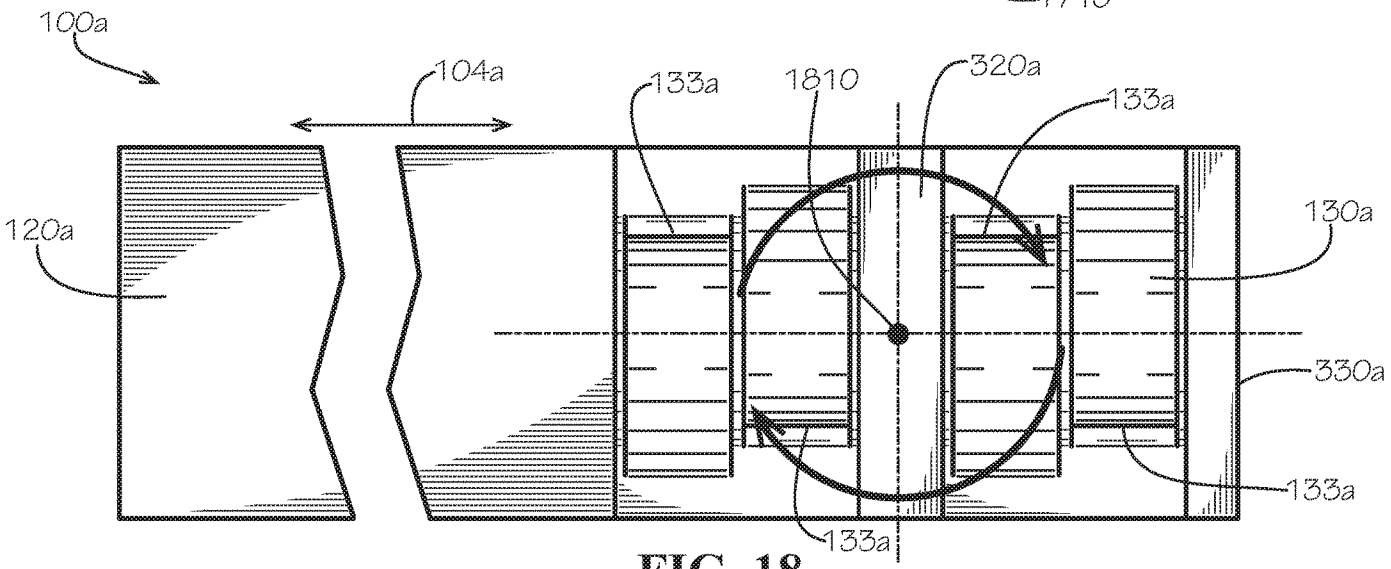
FIG. 18 is a top view of one segment of the first fastening device of FIG. 1.
Figure 20:
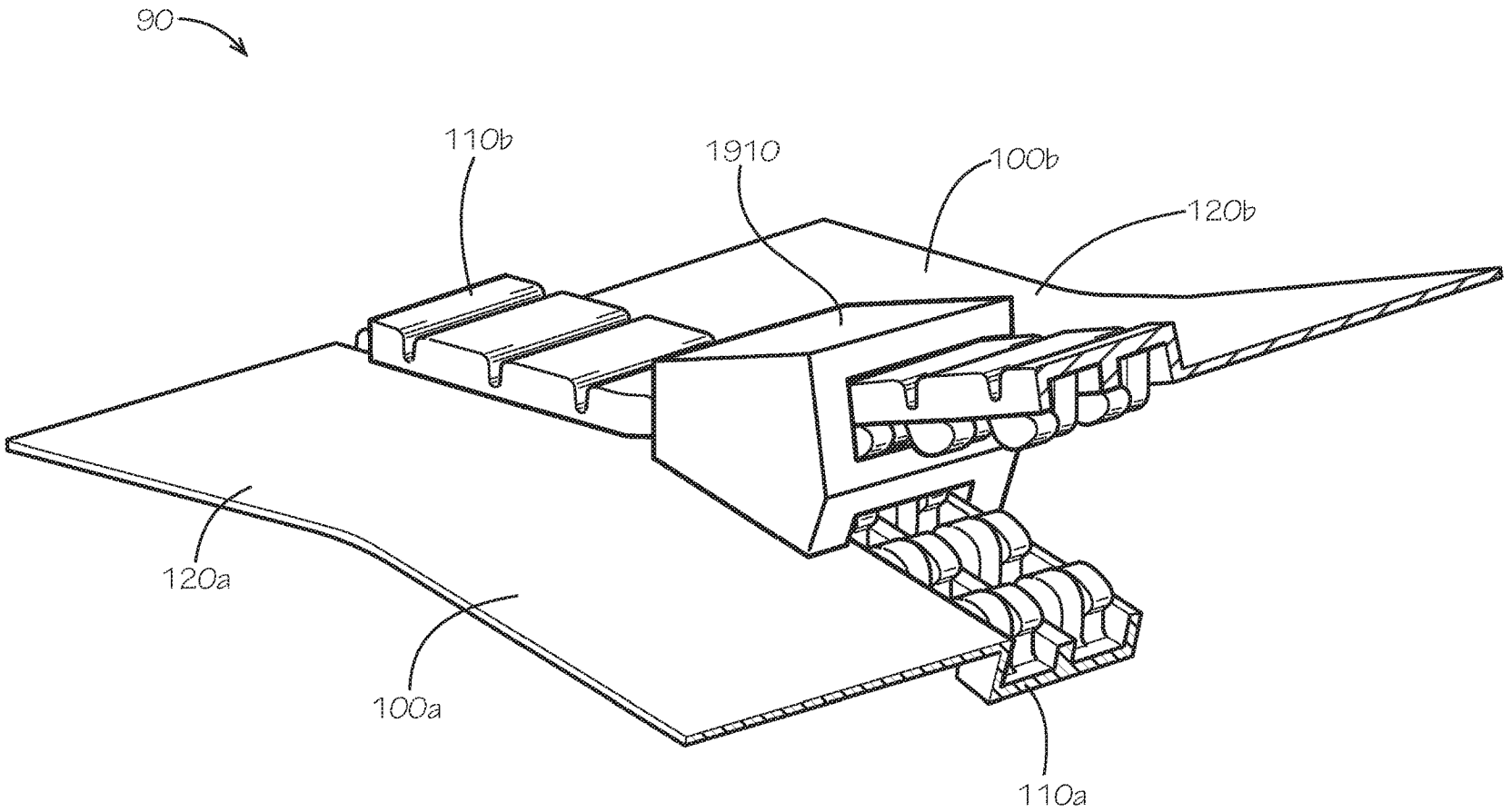
FIG. 20 is a perspective view of the fastening system of FIG. 1 comprising a slider for joining the first fastening device and the second device in accordance with another aspect of the current disclosure.

As shown in FIG. 18, when the fastening elements 130*a,b* of the fastening portion 110*a,b* are arranged in "point symmetry" or symmetric about a point 1810, it is possible to engage the two fastening devices 100*a,b*, at least as long as the mating portions of the fastening portions 110*a,b* have the same shape. In other words, through point symmetry the first fastening device can be configured to be joined to a second fastening device comprising a second fastening portion having the same geometry as the first fastening portion of the first fastening device. When point symmetry exists, laterally adjacent fastening elements 130*a* (i.e., fastening elements 130*a* that are adjacent to each other in the transverse direction 104*a,b* of the first fastening portion) are symmetric about a point positioned halfway between the laterally adjacent fastening elements. More specifically, when point symmetry exists every structural element has a matching structural element that is the same distance from the central point 1810 but in the opposite direction. In some aspects, the fastening portion 110*a,b* can be described as radially symmetric about an axis extending through the point 1810 such that one fastening element 130*a* can be rotated 180 degrees about the axis/point 1810 and will overlay another fastening element 130*a*. In addition, with either point symmetry or radially symmetry it is possible to engage the two fastening devices 100*a,b* in two different orientations. In some aspects, as shown in FIGS. 1 and 20, the first tape portion 120*a* can be made to extend in a first transverse direction parallel to the transverse direction 104*a* and the second tape portion 120*b* can be made to extend in a second transverse direction that is opposite the first transverse direction.

Each fastening element 130*a,b* can define an element width 1710 (shown in FIG. 17). In some aspects, the element width 1710 of fastening elements of each row such as the rows 331*a,b*,332*a,b*,333*a,b*,334*a,b* can be the same. In other aspects, the element width 1710 can vary between rows or between fastening elements 130*a,b* and the fastening device 100*a,b* still exhibit point symmetry or radial symmetry.

Figure 19:
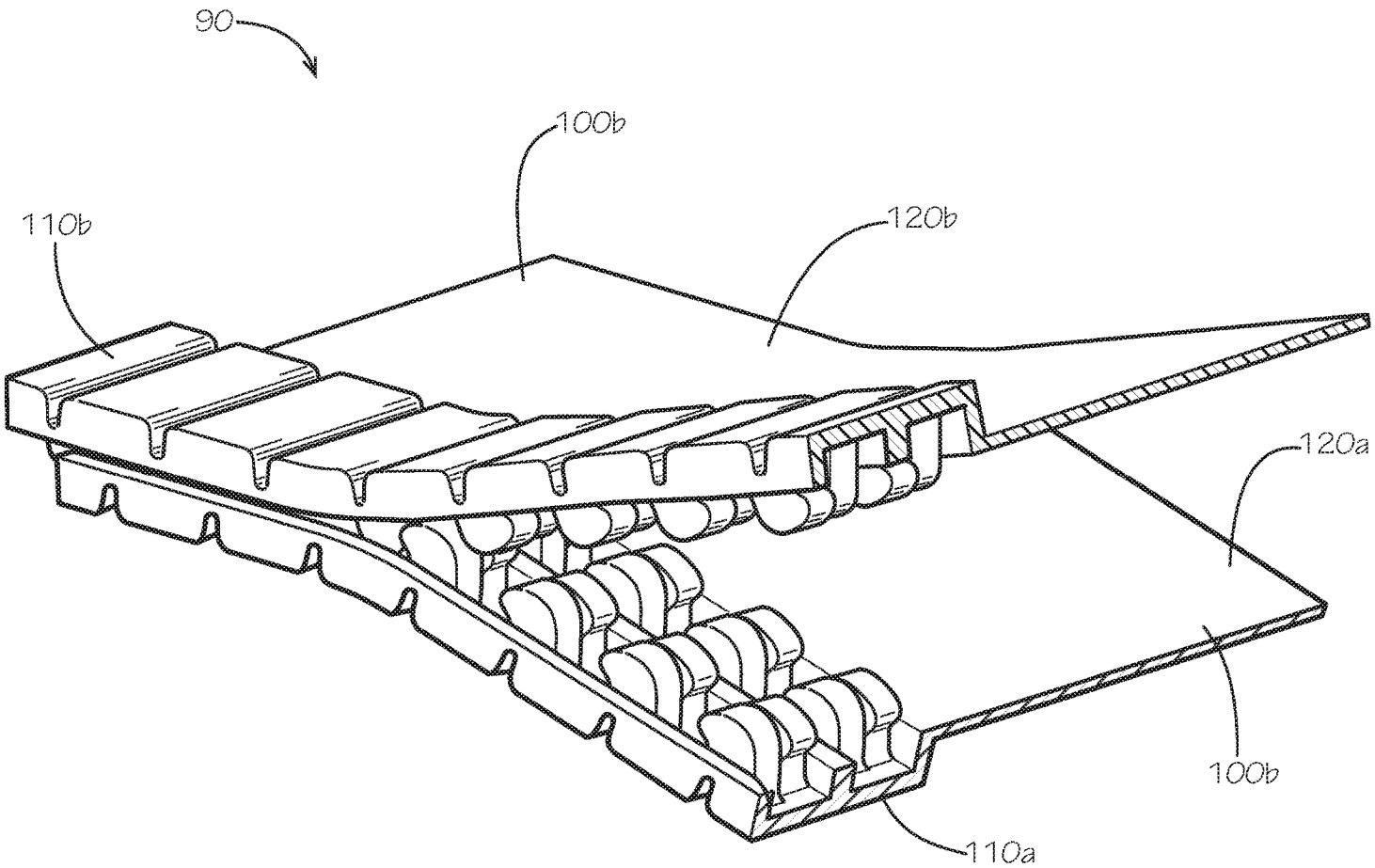
FIG. 19 is a perspective view of the fastening system of FIG. 1 wherein a first tape portion of the first fastening device and a second tape portion of the second fastening device extend in the same direction in accordance with another aspect of the current disclosure.

As shown in FIG. 19, in a fastening system 90 exhibiting point symmetry, both the first tape portion 120*a* and the second tape portion 120*b* can be made to extend in the same transverse direction 104*a*. In the fastening system 90 shown in FIG. 19, the fastening devices 100*a,b* can be engaged with each other using fingers and without a slider because one can access and therefore apply pressure more easily to the second side 112*a,b* of both the first fastening device 100*a* and the second fastening device 100*b* at the same time. As shown in FIG. 20, the fastening system 90 can comprise a slider 1910. The slider 1910 in a different configuration can be used with the fastening system 90 shown in FIG. 19 as well. The slider 1910 can, for example and without limitation, also comprise a pull tab or other structure for ergonomic operation. The slider 1910 can be simultaneously coupled to both the first fastening device 100*a* and the second fastening device 100*b* and be configured to selectively engage and disengage the second fastening device 100*b* from the first fastening device 100*a*, or vice versa.

Figure 21:
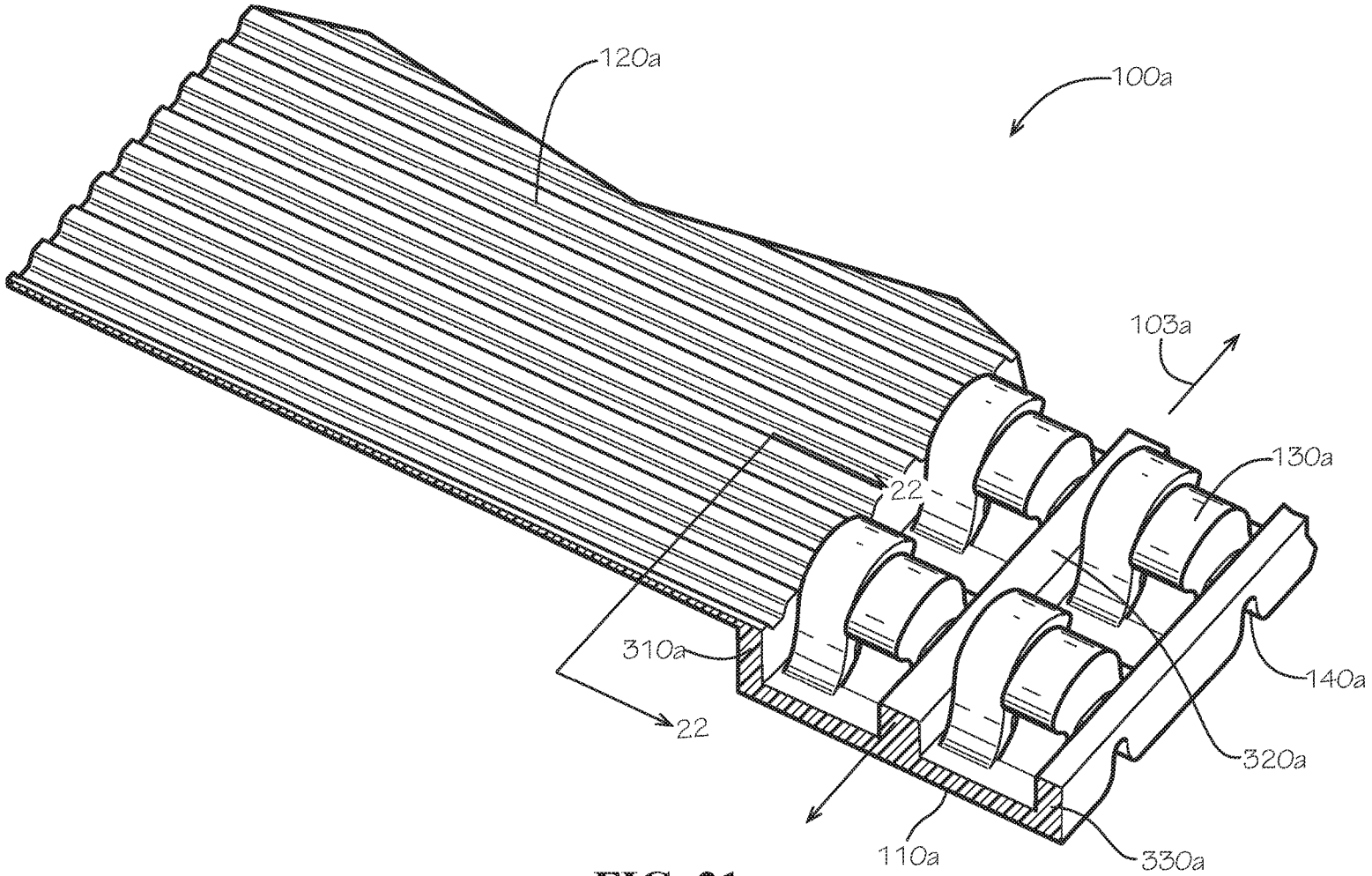
FIG. 21 is a perspective view of the first fastening device of FIG. 1 comprising a tape portion in accordance with another aspect of the current disclosure.
Figure 22:
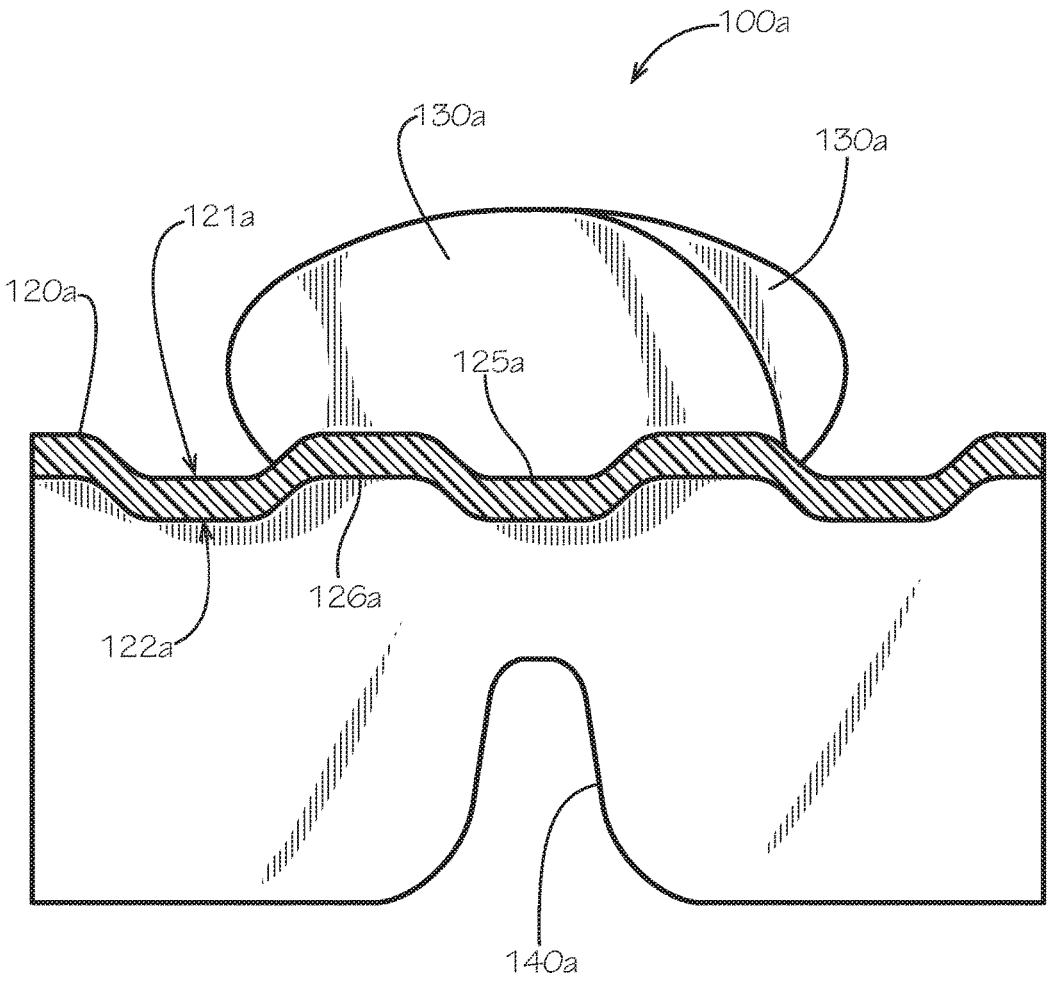
FIG. 22 is a sectional view of the first fastening device of FIG. 21 taken along line 22-22 of FIG. 21.

As shown in FIGS. 21 and 22, a tape portion such as the first tape portion 120*a* can be formed into a wave pattern in cross-section. With a tape portion 120*a,b* defining such a wave pattern, both the first side surface 121*a* and the second side surface 122*a* can define undulations 125*a*,126*a*, respectively, that can provide extra flexibility in the tape portion 120*a,b* and as a result make it possible to minimize the bend radius 610 (shown in FIG. 8) with both fastening devices 100*a,b* and with the assembled fastening system 90. Each of the undulations 125*a*,126*a* can be a recess in the first side surface 121*a* and the second side surface 122*a*, respectively.

Figure 23:
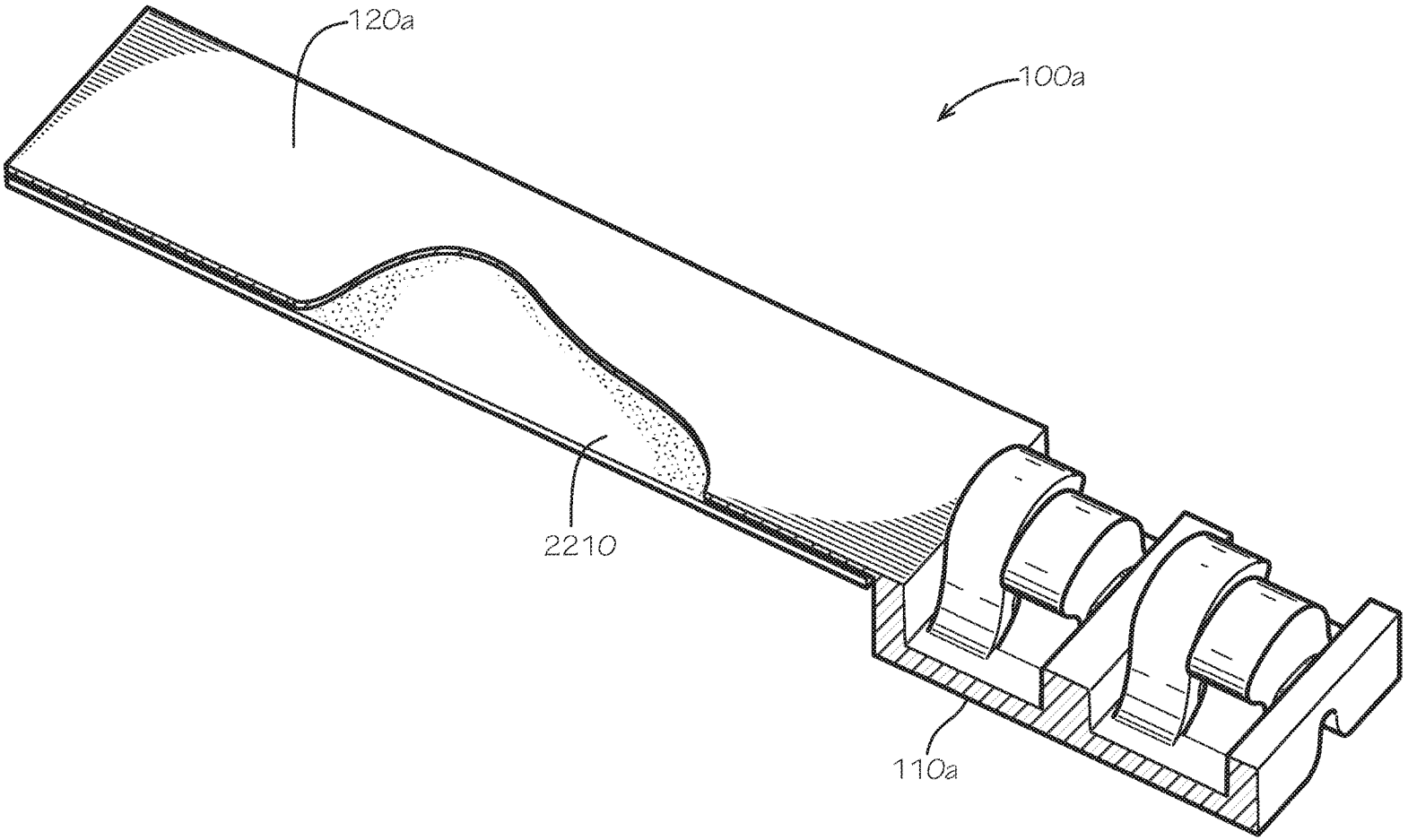
FIG. 23 is a perspective view of the first fastening device of FIG. 1 comprising a composite tape portion in accordance with another aspect of the current disclosure.

As shown in FIG. 23, an auxiliary tape 2210 can be secured to the first tape portion 120*a* by a process such as, for example and without limitation, insert extrusion, co-extrusion, welding, adhesion, sewing, or another chemical or mechanical joining method. In some aspects, the auxiliary tape 2210 itself can comprise a woven or non-woven fabric material. In other aspects, the auxiliary tape can be any other material including a metal, plastic or composite material sufficiently able to flex with the fastening devices 100*a,b* as desired.

Various methods exist for manufacturing the fastening devices 100*a,b* or components thereof, including those shown in U.S. Pat. No. 6,896,759 to Fujisawa, et al., which is hereby incorporated by reference in its entirety. In the processes disclosed therein (e.g., the processes using an extruding die wheel as shown in FIGS. 23, 25, 27, 29A, 29B, 32A, and 33), each of the fastening devices 100*a,b* can be quickly cooled after molding the fastening elements 130*a,b* but before removing the fastening elements 130*a,b* from the dies so as to avoid deformation of the fastening elements 130*a,b* while the material used to form the fastening devices 100*a,b* is still warm.

In some aspects, features formed from different materials, such as the seals 1410*a,b* formed from a resilient rubber or rubber-like material and the fastening devices 100*a,b* formed from a flexible but less resilient plastic resin, can be incorporated into the fastening devices using a process such as insert molding or co-extrusion. In other aspects, such features can be incorporated into the fastening devices 100*a,b* using welding, adhesion, or another chemical or mechanical joining method.

A method of using the fastening system 90 can comprise obtaining the first fastening device 100*a* and the second fastening device 100*b*. The method can further comprise fastening the second fastening portion 110*b* of the second fastening device 100*b* to the first fastening portion 110*a* of the first fastening device 100*a* when the first side surface 111*a* of the second fastening portion 110*b* is facing the first side surface of the first fastening portion 110*a*. The method can further comprise bending the fastening system 90 to decrease the bend radius 610 of the fastening system. In some aspects, the minimum bend radius 610 of the fastening system 90 can be adjusted by changing the shape and dimensions of the relieve grooves 140*a,b*.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A fastening system comprising:

a first fastening device comprising a first fastening portion and a first tape portion joined to the first fastening portion, the first fastening portion comprising a base defining a first side surface and a second side surface opposite from the first side surface, the first fastening portion comprising a plurality of fastening elements extending from the first side surface of the base of the first fastening portion, the plurality of fastening elements arranged lengthwise along a lengthwise direction of the first fastening device, each adjacent pair of fastening elements offset by a pitch distance and defining a fastening gap therebetween to define a plurality of fastening gaps of the first fastening portion, each of the plurality of fastening elements comprising an engagement portion extending in a direction parallel to the lengthwise direction of the first fastening device, the second side surface of the first fastening portion defining a plurality of relief grooves, the plurality of relief grooves substantially aligned in the lengthwise direction of the first fastening device with a fastening element of the first fastening portion of the first fastening device; and a second fastening device comprising a second fastening portion and a second tape portion joined to the second fastening portion, the second fastening portion comprising a base defining a first side surface and a second side surface opposite from the first side surface, the second fastening portion comprising a plurality of fastening elements extending from the first side surface of the base of the second fastening portion, the plurality of fastening elements of the second fastening portion arranged lengthwise along a lengthwise direction of the second fastening device, each adjacent pair of fastening elements offset by the pitch distance and defining a fastening gap therebetween to define a plurality of fastening gaps of the second fastening portion, each of the plurality of fastening elements of the second fastening portion comprising an engagement portion extending in a direction parallel to the lengthwise direction of the second fastening device, the second side surface of the second fastening portion defining a plurality of relief grooves, the plurality of relief grooves substantially aligned in the lengthwise direction of the second fastening device with a fastening element of the second fastening portion of the second fastening device;

wherein the second fastening portion of the second fastening device is configured to fasten to the first fastening portion of the first fastening device when the first side surface of the second fastening portion is facing the first side surface of the first fastening portion, each of the plurality of fastening gaps of the first fastening portion sized to lockably receive one of the plurality of fastening elements of the second fastening portion and each of the plurality of fastening gaps of the second fastening portion sized to lockably receive one of the plurality of fastening elements of the first fastening portion.

2. The system of claim 1, wherein the first tape portion and the plurality of fastening elements of the first fastening device are formed monolithically with each other and the second tape portion and the plurality of fastening elements of the second fastening device are formed monolithically with each other.

3. The system of claim 1, wherein the plurality of fastening elements of the first fastening device define a first row of fastening elements substantially aligned in the lengthwise direction of the first fastening device and the plurality of fastening elements of the second fastening device define a first row of fastening elements substantially aligned in the lengthwise direction of the second fastening device; the first fastening device further comprising a second row of fastening elements substantially aligned in the lengthwise direction of the first fastening device and positioned parallel to the first row of fastening elements of the first fastening device and the second fastening device further comprising a second row of fastening elements substantially aligned in the lengthwise direction of the second fastening device and positioned parallel to the first row of fastening elements of the second fastening device.

4. The system of claim 3, wherein each of the plurality of fastening elements in the second row of fastening elements of each of the first fastening device and the second fastening device comprises an engagement portion extending in a direction parallel to the lengthwise direction of the respective fastening device and opposite to the direction in which the engagement portions of the plurality of fastening elements in the first row of fastening elements of the respective fastening device extend.

5. The system of claim 1, wherein each of the plurality of fastening elements is asymmetric about a protrusional centerline of the fastening element.

6. The system of claim 1, wherein the first tape portion and the second tape portion are substantially coplanar.

7. The system of claim 1, wherein a wall of the first fastening device extending between a first row of fastening elements and a second row of fastening elements comprises a seal configured to create a watertight seal against the second fastening device during assembly of the second fastening device with the first fastening device.

8. The system of claim 1, further comprising a slider simultaneously coupled to both the first fastening device and the second fastening device and configured to selectively engage and disengage the second fastening device from the first fastening device.

9. A fastening device comprising:

a first tape portion; and a first fastening portion joined to the first tape portion, the first fastening portion defining a first side surface and a second side surface opposite from the first side surface, the first fastening portion comprising a plurality of fastening elements extending from the first side surface, the plurality of fastening elements arranged lengthwise along a lengthwise direction of the fastening device, the plurality of fastening elements defining a first row of fastening elements and a second row of fastening elements, each of the first row of fastening elements and the second row of fastening elements substantially aligned in the lengthwise direction of the fastening device, the second row of fastening elements positioned parallel to the first row of fastening elements, each adjacent pair of fastening elements offset by a pitch distance and defining a fastening gap therebetween, each of the plurality of fastening elements comprising an engagement portion extending in a direction parallel to the lengthwise direction of the fastening device, each of the plurality of fastening elements being asymmetric about a protrusional centerline of the fastening element, the fastening device being a first fastening device, the first fastening device configured to be joined to a second fastening device comprising a second fastening portion having the same geometry as the first fastening portion of the first fastening device.

10. The first fastening device of claim 9, wherein the first fastening portion is monolithically formed with the first tape portion.

11. The first fastening device of claim 9, wherein the first row of fastening elements and the second row of fastening elements define a lateral gap distance between the first row of fastening elements and the second row of fastening elements.

12. The first fastening device of claim 9, wherein laterally adjacent fastening elements of the first fastening portion are symmetric about a point positioned halfway between the laterally adjacent fastening elements when viewing the first side surface of the first fastening device.

13. The first fastening device of claim 9, further comprising a wall extending from the first side between the first row of fastening elements and the second row of fastening elements.

14. The first fastening device of claim 13, wherein the wall is segmented.

15. The first fastening device of claim 9, further comprising a third row of fastening elements and a fourth row of fastening elements, the third row of fastening elements substantially aligned in the lengthwise direction of the first fastening device and positioned adjacent to and offset from the first row of fastening elements of the first fastening device in a direction extending away from the second row of fastening elements, the fourth row of fastening elements substantially aligned in the lengthwise direction of the first fastening device and positioned adjacent to and offset from the second row of fastening elements of the first fastening device in a direction extending away from the first row of fastening elements.

16. The first fastening device of claim 9, wherein the second side surface of the first fastening portion defines a plurality of relief grooves.

17. A fastening device comprising:

a first tape portion; and a first fastening portion joined to the first tape portion, the first fastening portion defining a first side surface and a second side surface opposite from the first side surface, the first fastening portion comprising a plurality of fastening elements extending from the first side surface, the plurality of fastening elements arranged lengthwise along a lengthwise direction of the fastening device, each adjacent pair of fastening elements offset by a pitch distance and defining a fastening gap therebetween, each of the plurality of fastening elements comprising an engagement portion extending in a direction parallel to the lengthwise direction of the fastening device, the second side surface of the first fastening portion defining a plurality of relief grooves, the fastening device being a first fastening device, the first fastening device configured to be joined to a second fastening device comprising a second fastening portion having the same geometry as the first fastening portion of the first fastening device.

18. The first fastening device of claim 17, wherein each of the plurality of fastening elements is asymmetric about a protrusional centerline of the fastening element.

* * * * *